US009318860B2

(12) United States Patent
Fukano et al.

(10) Patent No.: US 9,318,860 B2
(45) Date of Patent: Apr. 19, 2016

(54) LIGHT SOURCE, LAMP SOCKET AND ILLUMINATION DEVICE USING THE LAMP SOCKET

(75) Inventors: Satoshi Fukano, Ikoma (JP); Yoshihisa Ando, Beijing (CN); Yosihide Imaoka, Hirakata (JP); Noboru Miyakawa, Moriguti (JP)

(73) Assignee: Panasonic Corporation (JP)

( * ) Notice: Subject to any disclaimer, the term of this patent is extended or adjusted under 35 U.S.C. 154(b) by 770 days.

(21) Appl. No.: 13/053,375

(22) Filed: Mar. 22, 2011

(65) Prior Publication Data

US 2011/0235319 A1 Sep. 29, 2011

(30) Foreign Application Priority Data

Mar. 23, 2010 (JP) ..... 2010-066453
Mar. 23, 2010 (JP) ..... 2010-066861

(51) Int. Cl.
*F21V 23/06* (2006.01)
*F21K 99/00* (2010.01)
(Continued)

(52) U.S. Cl.
CPC ..... *H01R 33/0854* (2013.01); *F21K 9/175* (2013.01); *F21K 9/30* (2013.01);
(Continued)

(58) Field of Classification Search
CPC ..... H05B 33/0815; H05B 37/02; H05B 33/0803; H05B 41/2983; H05B 41/2988; H05B 37/0263; H05B 41/00; Y10S 315/05; Y10S 315/07; F21Y 2101/02; F21Y 2103/00; A61L 2209/12; A61L 9/03; F21K 9/175; F21K 9/30; G09G 3/3406; H05K 5/0017; Y02B 20/346; Y02B 20/19; Y02B 20/48; F21S 8/031; F21S 8/04; H01J 61/025; H01J 61/322; H01J 61/325; H01J 61/56; H01R 33/0818; H01R 33/0836; H01R 33/0854; F21V 23/06
USPC ..... 362/217.14, 217.1, 217.08, 217.09, 362/217.11, 217.12, 217.13, 217.15, 362/217.16, 217.17, 614, 260, 218, 145, 362/147, 225, 241, 249.02, 253, 295; 315/224, 291, 307, 100, 290, 297, 308, 315/310, 312, 72; 257/88
See application file for complete search history.

(56) References Cited

U.S. PATENT DOCUMENTS 2,799,801 A * 7/1957 Freeman ..... 315/32
3,285,560 A * 11/1966 Pistey ..... 248/342
(Continued)

FOREIGN PATENT DOCUMENTS

CN 2080718 U 7/1991
CN 2094117 U 1/1992
(Continued)

OTHER PUBLICATIONS

The Japanese Office Action dated Dec. 20, 2011 and English summary thereof.
(Continued)

*Primary Examiner* — Stephen F Husar
*Assistant Examiner* — Danielle Allen
(74) *Attorney, Agent, or Firm* — Bacon & Thomas, PLLC

(57) ABSTRACT

A light source has an outer size set equal to the dimension of a straight tubular fluorescent lamp. The light source includes a straight light emitting tube and end caps provided at the opposite end portions of the light emitting tube. Each of the end caps includes first pins arranged at the same positions as lamp pins of the fluorescent lamp. The first pins have the same shape as the lamp pins of the fluorescent lamp. Further, at least one of the end caps includes a current-feeding second pin.

15 Claims, 21 Drawing Sheets

(51) Int. Cl.

| | |
|---|---|
| ***H01R 33/08*** | (2006.01) |
| *H05B 37/02* | (2006.01) |
| *F21S 8/00* | (2006.01) |
| *F21Y 101/02* | (2006.01) |

(52) U.S. Cl.
CPC ..... *F21V 23/06* (2013.01); *F21S 8/031* (2013.01); *F21Y 2101/02* (2013.01); *H01R 33/0818* (2013.01); *H05B 37/0263* (2013.01)

(56) References Cited

U.S. PATENT DOCUMENTS

| | | | | |
|---|---|---|---|---|
| 2005/0202704 | A1* | 9/2005 | Lingemann et al. | 439/236 |
| 2008/0151537 | A1 | 6/2008 | Robertson | |
| 2009/0159919 | A1* | 6/2009 | Simon et al. | 257/99 |
| 2010/0008091 | A1 | 1/2010 | Iida et al. | |
| 2010/0253226 | A1* | 10/2010 | Oki | 315/113 |
| 2010/0270925 | A1* | 10/2010 | Withers | 315/51 |
| 2011/0149563 | A1* | 6/2011 | Hsia et al. | 362/221 |

FOREIGN PATENT DOCUMENTS

| | | | |
|---|---|---|---|
| CN | 2687494 | Y | 3/2005 |
| CN | 2903657 | Y | 5/2007 |
| CN | 101619819 | A | 1/2010 |
| CN | 201377701 | Y | 1/2010 |
| DE | 2938247 | B1 | 10/1980 |
| JP | 2001/338506 | | 12/2001 |
| JP | 2004-30929 | A | 1/2004 |
| JP | 2004030929 | | 1/2004 |
| JP | 2004-303614 | | 10/2004 |
| JP | U3119578 | | 2/2006 |
| JP | 2008-210943 | | 9/2008 |
| JP | 2009-176680 | A | 8/2009 |
| JP | 2010-123097 | | 6/2010 |
| JP | 2011-192491 | | 9/2011 |

OTHER PUBLICATIONS

The Chinese Office Action dated May 14, 2013 and English translation thereof.

The Japanese Office Action dated Mar. 27, 2012 and English summary thereof.

The Chinese Office Action dated Aug. 13, 2014 (w/English translation).

* cited by examiner

LIGHT SOURCE, LAMP SOCKET AND ILLUMINATION DEVICE USING THE LAMP SOCKET

FIELD OF THE INVENTION

The present invention relates to a light source, a lamp socket and an illumination device using the lamp socket.

BACKGROUND OF THE INVENTION

In recent years, a fluorescent-lamp-type light emitting diode lamp (hereinafter referred to as "LED lamp") attachable to an existing illumination device for fluorescent lamps becomes commercially available as an alternative light source to a fluorescent lamp (see, e.g., Japanese Patent Application Publication No. 2004-30929 (JP2004-30929A). The LED lamp (or the LED device) disclosed in JP2004-30929A includes a tubular light-transmitting member and a plurality of light emitting diodes (LEDs) arranged within the light-transmitting member. The light-transmitting member is provided with end caps at its opposite ends. The end caps are mounted to a lamp socket of an illumination device. The LEDs emit light as the electric power is supplied to the LEDs from a lighting unit through the lamp socket.

The method of mounting such a fluorescent-lamp-type LED lamp differs from maker to maker. For example, when one wishes to use the LED lamp in an existing illumination device for fluorescent lamps, the illumination device needs to be remodeled by removing a lighting unit for fluorescent lamps and newly installing a lighting device for LED lamps.

Since the fluorescent lamp and the fluorescent-lamp-type LED lamp look as if they have the same shape, it is likely that a user may confuse the remodeled illumination device with the existing illumination device and may mistakenly mount a fluorescent lamp to the remodeled illumination device. The lighting units for the fluorescent lamp and the LED lamp are designed differently. Therefore, if the fluorescent lamp is mistakenly mounted to the remodeled illumination device, there is a possibility that the fluorescent lamp cannot be turned on and may be adversely affected. In case where a fluorescent-lamp-type LED lamp of different specifications produced by another maker is mistakenly mounted to the remodeled illumination device, there still remains a possibility that the LED lamp cannot be turned on and may be adversely affected as in the case of mounting the fluorescent lamp.

In an effort to prevent erroneous mounting of a lamp, there has been proposed an LED illumination device with specialized end caps (see, e.g., JP2004-30929A).

The LED illumination device disclosed in JP2004-30929A is capable of preventing erroneous mounting of a lamp by using the specialized end caps to eliminate interchangeability with a fluorescent lamp. However, this makes it necessary to replace a lamp socket when the LED lamp is replaced by a fluorescent lamp. In other words, the conventional lamp socket is not usable with both the fluorescent lamp and the LED lamp.

SUMMARY OF THE INVENTION

In view of the above, the present invention provides a light source interchangeable with a fluorescent lamp, a lamp socket usable with both the light source and the fluorescent lamp without having to replace the lamp socket and an illumination device using the lamp socket.

In accordance with a first embodiment of the invention, there is provided a light source having an outer size set equal to the dimension of a straight tubular fluorescent lamp, including: a straight light emitting tube; and end caps provided at the opposite end portions of the light emitting tube, wherein each of the end caps includes first pins arranged at the same positions as lamp pins of the fluorescent lamp, the first pins having the same shape as the lamp pins of the fluorescent lamp, and at least one of the end caps includes a current-feeding second pin.

The second pin may be arranged in each of the end caps so that a lighting current is fed the light source through the second pin.

A lighting current may be fed though the second pin and one of the first pins.

The second pin may be arranged in a coaxial relationship with a lamp axis, the first pins and the second pin being arranged side by side along a straight line orthogonal to the lamp axis.

The second pin may be greater in length than the first pins.

At least a portion of the second pin may have a size greater than a groove width of a pin insertion groove provided in a rotor of a lamp socket to which the fluorescent lamp is mounted in a rotatable manner but smaller than a groove width of a pin insertion groove provided in a rotor of a lamp socket to which the light source is mounted in a rotatable manner.

The second pin may be arranged to protrude in a direction orthogonal to the lamp axis.

A lamp socket may include: a socket body; end cap receiving units to which the end caps of the light source or end caps of the fluorescent lamp recited above are respectively mounted in a removable manner, each of the end cap receiving units including first current-feeding terminals to which the first pins are connected, a second current-feeding terminal to which the second pin is connected and an insertion groove into which the first pins and the second pin are inserted, the first current-feeding terminals and the second current-feeding terminal being arranged within the socket body; and a rotor attached to the socket body for rotation about a lamp axis with respect to the socket body, the light source or the fluorescent lamp being mounted to the socket as the light source or the fluorescent lamp is rotated about the lamp axis together with the rotor in a state that the first pins and the second pin of the light source or the lamp pins of the fluorescent lamp are inserted into the insertion groove.

The second current-feeding terminal may be arranged at the opposite side of the first current-feeding terminals from the lamp.

A lamp socket may include: end cap receiving units to which the end caps of the light source or the end caps of the fluorescent lamp recited above are respectively mounted in a removable manner, each of the end cap receiving units including first current-feeding terminals to which the first pins are connected, a second current-feeding terminal to which the second pin is connected and an insertion groove into which the first pins of the light source or the lamp pins of the fluorescent lamp are inserted; and a plunger biased toward the lamp, the light source or the fluorescent lamp being mounted to the socket as the light source or the fluorescent lamp is displaced toward the plunger in a state that each of the end caps of the light source or each of the end caps of the fluorescent lamp is brought into contact with the plunger.

The lamp socket may further include: a socket body for accommodation of the first current-feeding terminals and the second current-feeding terminal, the second pin being arranged to protrude in a direction orthogonal to a lamp axis, the socket body including an insertion groove into which the second pin is inserted, the second pin being inserted into the socket body through the insertion groove and connected to the second current-feeding terminal when the light source is mounted in place.

An illumination device may include: the lamp socket recited above; and a lighting circuit for supplying a lighting current to the lamp socket.

In accordance with a second embodiment of the invention, there is provided a light source differing from a fluorescent lamp, including: a light-emitting unit; end caps mountable to sockets of an existing illumination device for the fluorescent lamp; and a current-feeding unit for feeding a lighting current to the light-emitting unit via a current-feeding path detouring the sockets, the current-feeding unit being positioned to face the illumination device when the end caps are mounted to the sockets.

The end caps may be provided in pair. The current-feeding unit may be arranged in a middle position between the end caps.

The light source may further include: a straight tubular body arranged to accommodate the light-emitting unit, the end caps being provided at the opposite ends of the tubular body.

The light-emitting unit may is positioned outward of the sockets when the end caps are mounted to the sockets.

An illumination device may include: sockets to which end caps of a fluorescent lamp are respectively mounted; a first lighting unit for feeding a lighting current to the fluorescent lamp through the sockets; a device body arranged to hold the sockets and to accommodate the first lighting unit; a second lighting unit accommodated within the device body to feed the lighting current to the light source recited above; a current-feeding unit provided on one surface of the device body on which the sockets are arranged; and a connection unit arranged to establish a current-feeding path extending from the second lighting unit to the light source through the connection unit and the current-feeding unit.

The current-feeding unit and the connection unit may include a holder unit arranged to mechanically hold the current-feeding unit and the connection unit.

The current-feeding unit may be attached to the connection unit simultaneously with the end caps being mounted to the sockets.

With the present invention noted above, it is possible to provide a light source interchangeable with a fluorescent lamp, a lamp socket usable with both the light source and the fluorescent lamp without having to replace the lamp socket and an illumination device using the lamp socket.

The light source of the present invention is mountable to the existing fluorescent-lamp socket of an illumination device. When the light source is mounted to the socket, there is no need to feed an electric current through the socket. Accordingly, it is possible to jointly use the existing fluorescent lamp and other light sources in an easy and safe manner without having to replace the socket.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Embodiments of a light source, a lamp socket and an illumination device using the lamp socket will now be described with reference to the accompanying drawings which form a part hereof. In the following description, unless specifically mentioned otherwise, the direction indicated by an arrow a-b in FIG. 5 will be referred to as front-rear direction, the direction indicated by an arrow c-d in FIG. 5 as left-right direction, and the direction indicated by an arrow e-f in FIG. 5 as up-down direction.

First Embodiment

Figure 4A:
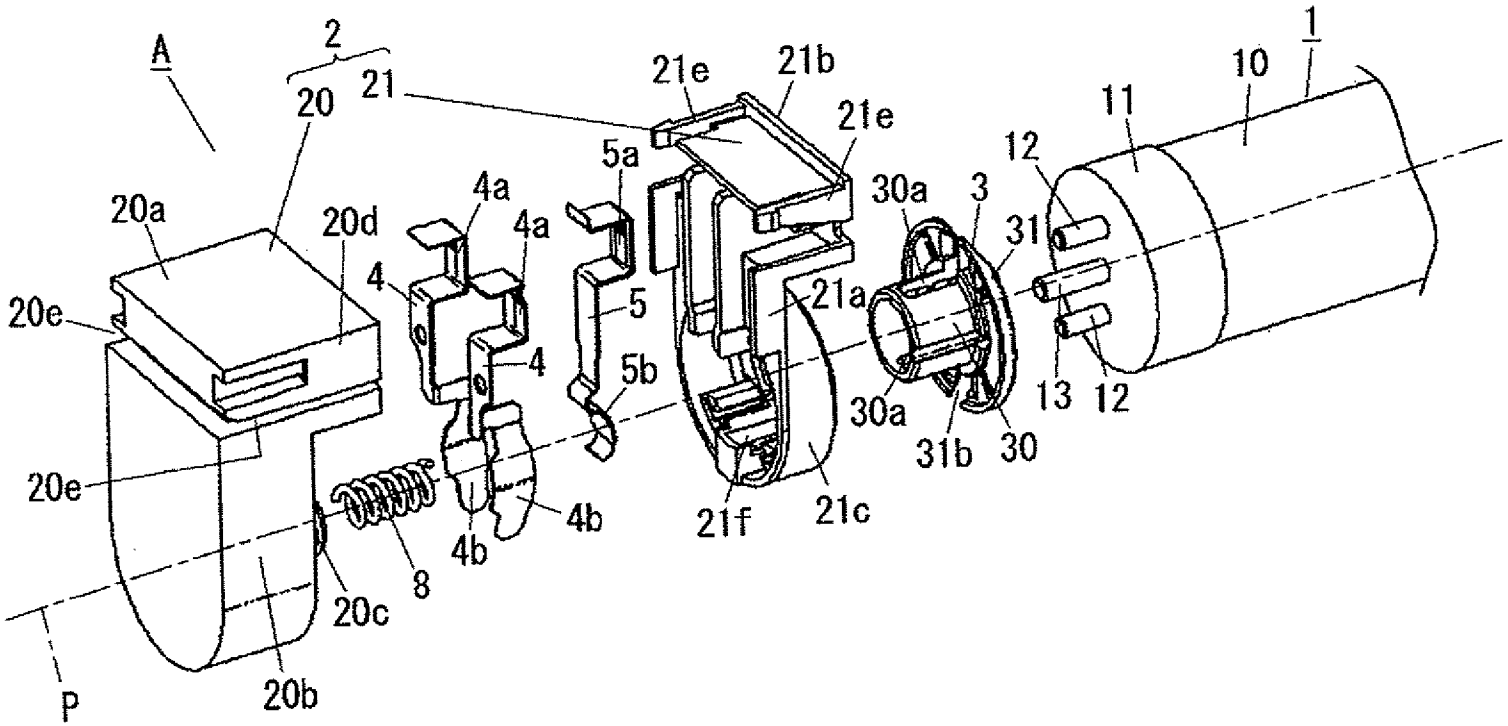
FIG. 4A is an exploded perspective view showing a lamp socket according to a first embodiment of the present invention.

The lamp socket A according to a first embodiment of the present invention is usable with both a well-known fluorescent lamp 1' (see FIG. 9) and an alternative lamp 1 (see FIGS. 1A to 1C) to be set forth later. As shown in FIG. 4A, the lamp socket A includes, as its major components, a socket body 2, a rotor (or a rotating member) 3, a pair of current-feeding terminals (first current-feeding terminals) 4, and a current-feeding terminal (second current-feeding terminal) 5.

The socket body 2 includes a box-shaped base 20 opened at its front side and a cover 21 attached to the base 20 in such a fashion as to close the front opening of the base 20. The base 20 and the cover 21 are all molded with a synthetic resin.

The base 20 includes an upper wall portion 20*a*, side wall portions 20*b* and fit portions 20*d* formed in the connection portions where the upper wall portion 20*a* is connected to the side wall portions 20*b*. The cover 21 includes fit protrusions 21*e* fitted to the fit portions 20*d*.

The base 20 further includes insertion grooves 20*e* formed below the fit portions 20*d* on the respective side wall portions 20*b* to extend in the front-rear direction. Ribs (not shown) of a device body 100 (see FIG. 9) are inserted into the insertion grooves 20*e* when the lamp socket A is attached to the device body 100. The base 20 further includes a fit cylinder portion 20*c* formed on the bottom surface of the base 20 to protrude in the forward direction. The fit cylinder portion 20*c* engages with the rotor 3 and keeps the rotor 3 in place.

The cover 21 includes a flat cover body 21*a* for closing the front opening of the base 20 and a terminal block 21*b* integrally formed with the cover body 21*a*. The cover 21 further includes a cylindrical terminal holder portion 21*c* integrally formed with the cover body 21*a* at the front side of the cover body 21*a*. A plurality of (three, in FIG. 5) wire insertion holes 21*d*, into which electric wires (not shown) are to be inserted, is formed on the front surface of the terminal block 21*b*. The fit protrusions 21*e* protruding toward the base 20 are formed at the left and right end portions of the terminal block 21*b*. A circular insertion hole (not shown), into which the cylinder portion 30 of the rotor 3 is to be inserted, is formed on the front surface of the terminal holder portion 21*c*. An insertion groove 21*f*, into which lamp pins 12' of a fluorescent lamp 1' or first and second pins 12 and 13 of an alternative lamp 1 are to be inserted, is formed in the lower area of the terminal holder portion 21*c* in a communicating relationship with the insertion hole. In this regard, the socket body 2 can be assembled together by fitting each of the fit protrusions 21*e* of the cover 21 to the corresponding one of the fit portions 20*d* of the base 20.

Figure 5:
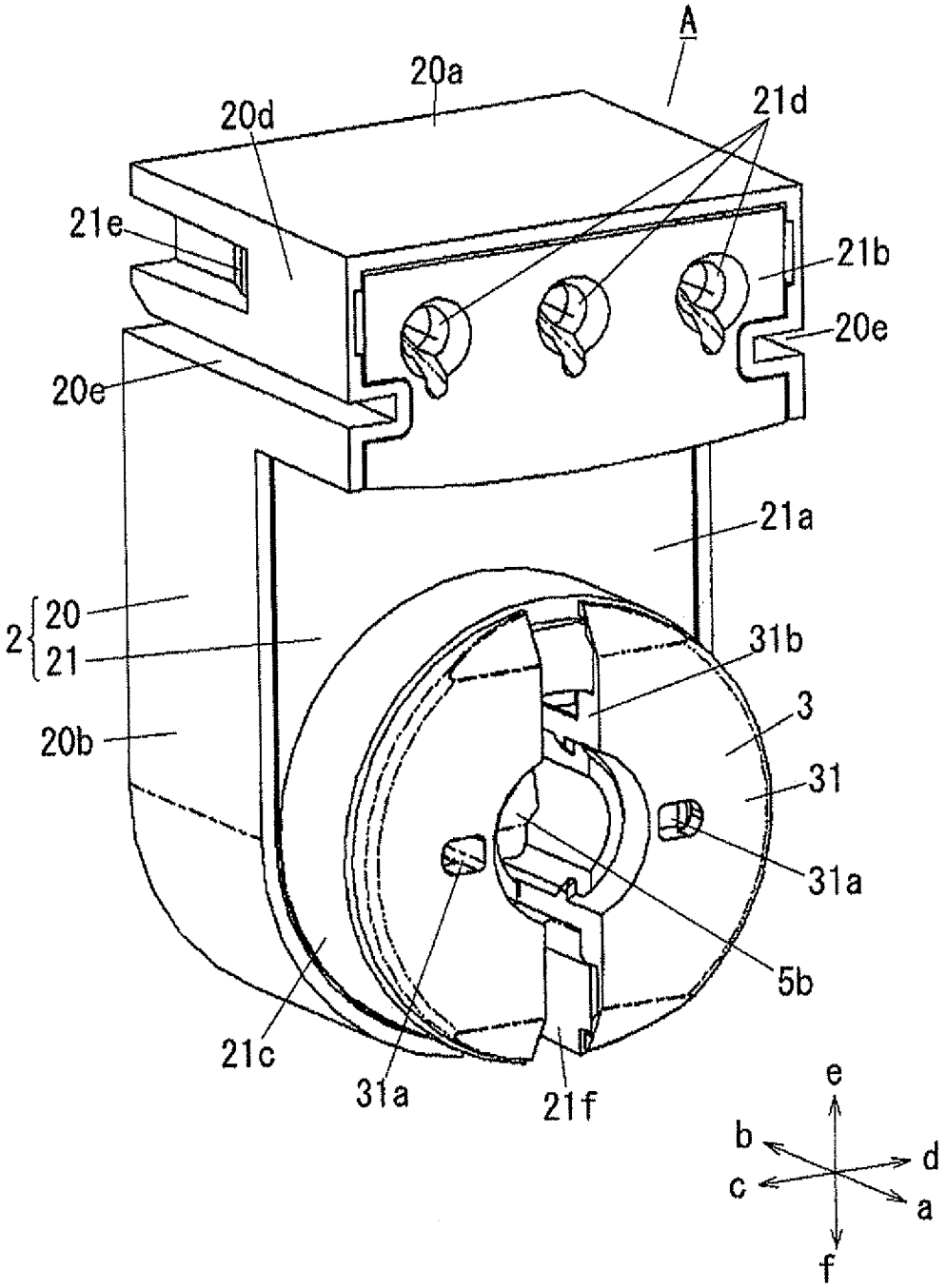
FIG. 5 is a perspective view showing the outward appearance of the lamp socket.

The rotor 3 includes a disk-shaped rotor body 31 and a cylinder portion 30 rotatably fitted to the fit cylinder portion 20*c* of the base 20. The rotor body 31 and the cylinder portion 30 are integrally molded from a synthetic resin. As can be seen in FIG. 5, the rotor body 31 has an insertion groove 31*b* extending in the up-down direction and terminal observation holes 31*a* arranged at the left and right side of the insertion groove 31*b*. As shown in FIG. 4A, insertion grooves 30*a* communicating with the insertion groove 31*b* of the rotor body 31 are provided in the upper and lower walls of the cylinder portion 30. The width of the insertion grooves 21*f*, 31*b* and 30*a* is set such that the first and second pins 12 and 13 of the alternative lamp 1 can be inserted into the insertion grooves 21*f*, 31*b* and 30*a*. When the lamp socket A is in an assembled state, the insertion groove 21*f* of the terminal holder portion 21*c*, the insertions hole 31*b* of the rotor body 31 and the insertion grooves 30*a* of the cylinder portion 30 are arranged in a mutually communicating relationship so that the first and second pins 12 and 13 (or the lamp pins 12') can be inserted into the insertion grooves 21*f*, 31*b* and 30*a* from below in the process of mounting the alternative lamp 1 (or the fluorescent lamp 1'). The order of mounting the lamp will be described later.

Each of the current-feeding terminals 4 is made of an electrically conductive material (e.g., copper) with elasticity and includes a current-receiving terminal portion 4*a* to which each of the electric wires (not shown) inserted into the socket body 2 through the wire insertion holes 21*d* is electrically connected and a current-feeding terminal portion 4*b* from which a high-frequency current is fed to the fluorescent lamp 1' through the lamp pins 12' of the latter. The current-receiving terminal portion 4*a* and the current-feeding terminal portion 4*b* are bent into a single piece. In the present embodiment, the current-receiving terminal portion 4*a* has a quick-coupling terminal structure. Therefore, each of the electric wires can be connected to the current-receiving terminal portion 4*a* by merely inserting the electric wires into the wire insertion holes 21*d*. The current-feeding terminals 4 are respectively arranged within the recessed accommodation portions (not shown) formed in the cover 21 (namely, in the cover body 21*a*, the terminal block 21*b* and the terminal holder portion 21*c*). A high-frequency current is supplied to the fluorescent lamp 1' as the current-feeding terminal portions 4*b* come into contact with the lamp pins 12' of the fluorescent lamp 1'.

Just like the current-feeding terminals 4, the current-feeding terminal 5 is made of an electrically conductive material (e.g., copper) with elasticity and includes a current-receiving terminal portion 5*a* to which the electric wire (not shown) inserted into the socket body through the wire insertion hole 21*d* is electrically connected and a current-feeding terminal portion 5*b* from which a desired lighting current (e.g., a direct current) is supplied to the alternative lamp (e.g., an LED lamp called an LED light source) 1. The current-receiving terminal portion 5*a* and the current-feeding terminal portion 5*b* are bent into a single piece. Just like the current-feeding terminals 4, the current-feeding terminal 5 is arranged within the recessed accommodation portion (not shown) formed in the cover 21. When in an assembled state, the current-feeding terminal 5 is positioned rearwards of the current-feeding terminals 4 (at the opposite side of the current-feeding terminals 4 from the lamp). A spring 8 is attached to the rear surface of the current-feeding terminal portion 5*b* to bias the current-feeding terminal portion 5*b* forwards. In the present embodiment, the current-feeding terminals 4, the current-feeding terminal 5 and the rotor 3 make up an end cap receiving unit.

FIG. 5 is a perspective view showing the outward appearance of the lamp socket A according to the present embodiment. The rotor body 31 is arranged so that the insertion groove 31*b* can extend in the up-down direction. The insertion groove 21*f* of the terminal holder portion 21*c* and the insertion grooves 30*a* of the cylinder portion 30 are aligned with the insertion groove 31*b*. The current-feeding portion 5*b* of the current-feeding terminal 5 is arranged to face outwards through the insertion groove 31*b*.

Figure 1A:
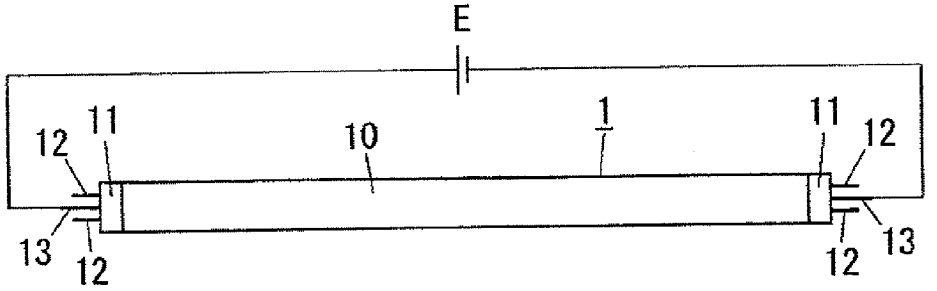
FIGS. 1A through 1C are views explaining how to feed an electric current to an alternative lamp according to a first embodiment of the present invention.
Figure 2A:
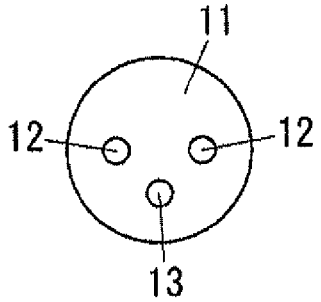
FIGS. 2A through 2D are views showing pin arrangement variations in the alternative lamp.
Figure 2B:
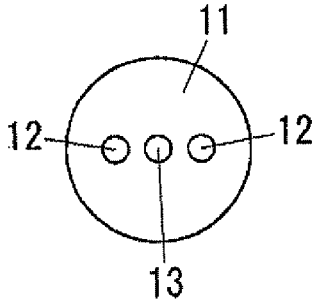
Figure 2C:
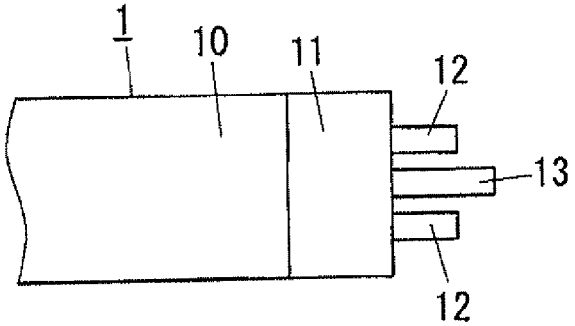

Referring now to FIG. 1A, there is shown a light source according to the present embodiment, i.e., an alternative lamp 1 interchangeable with the well-known fluorescent lamp 1'. The alternative lamp 1 includes a straight light emitting tube 10 and a pair of end caps 11 provided at the longitudinal opposite end portions (i.e., the opposite end portions in the left-right direction in FIG. 1A) of the light emitting tube 10. The outer size of the alternative lamp 1 (namely, the length of the alternative lamp 1 and the dimension of the portions of the end caps 11 to be mounted to the lamp socket) is set equal to the outer size of the fluorescent lamp 1'. Each of the end caps 11 includes first pins 12 having the same shape as those of the fluorescent lamp 1'. The first pins 12 are arranged in the same positions as the lamp pins 12' of the fluorescent lamp 1'. Each of the end caps 11 further includes a second pin 13 used in feeding an electric current. A printed board (not shown) mounted with, e.g., a plurality of LEDs, is contained within the light emitting tube 10. The LEDs are turned on by a direct current E supplied through the second pins 13 of the respective end caps 11. In the present embodiment, as shown in FIG. 2B, the second pin 13 is arranged in a coaxial relationship with the lamp axis P (see FIG. 4A). The first pins 12 and the second pin 13 are arranged side by side along a line orthogonal to the lamp axis P. As can be seen in FIG. 2C, the second pin 13 is longer than the first pins 12.

Figure 4B:
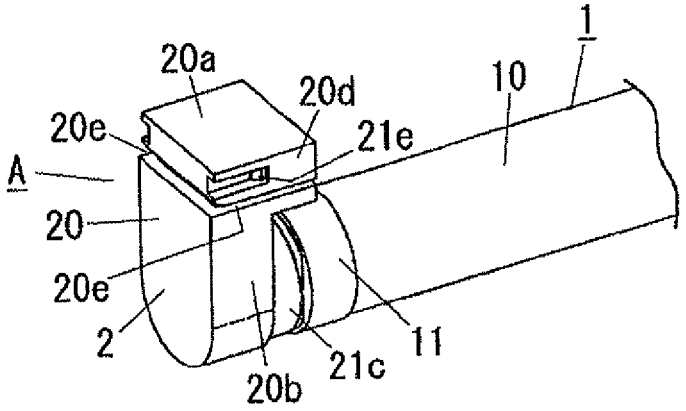
FIG. 4B is a perspective view showing the lamp socket mounted with the alternative lamp.
Figure 6A:
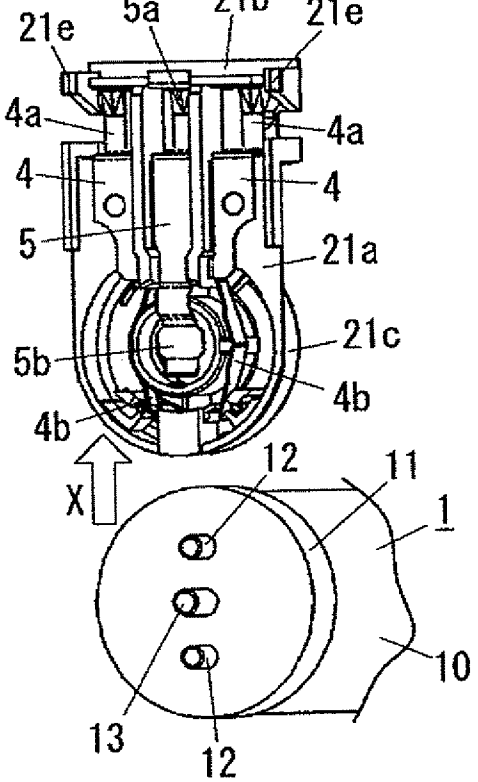
FIGS. 6A through 6C are views explaining the order of mounting the alternative lamp to the lamp socket.
Figure 6B:
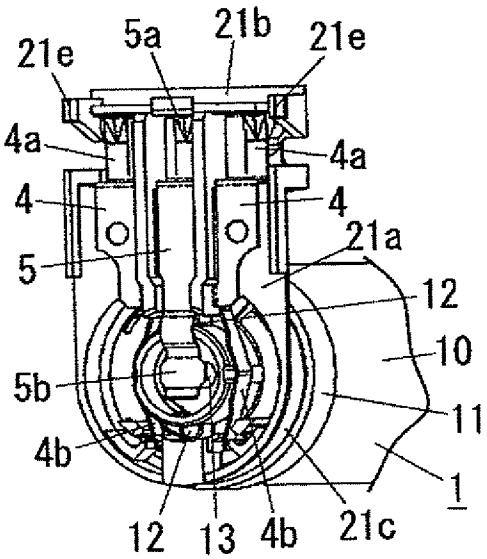
Figure 6C:
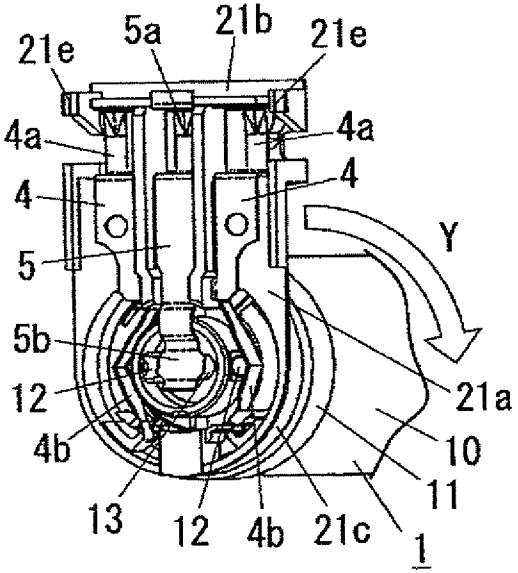

Next, the order of mounting the alternative lamp 1 to the lamp socket A will be described with reference to FIGS. 6A to 6C. Referring first to FIG. 6A, the alternative lamp 1 is so oriented that the row of the first pins 12 and the second pin 13 of each of the end caps 11 can extend in the up-down direction, after which the alternative lamp 1 is moved upwards (namely, in the direction indicated by an arrow X in FIG. 6A). At this time, the first pins 12 and the second pin 13 pass through the insertion groove 21*f* of the terminal holder portion 21*c*, the lower insertion groove 30*a* of the cylinder portion 30 and the insertion groove 31*b* of the rotor body 31, and move upwards to a specified position where the upper first pin 12 makes contact with the marginal edge of the opening of the insertion hole (not shown) defined in the terminal holder portion 21*c*. If the alternative lamp 1 is moved until the upper first pin 12 reaches the specified position, the second pin 13 comes into contact with the current-feeding terminal portion 5*b* of the current-feeding terminal 5 as shown in FIG. 6B. If the alternative lamp 1 and the rotor 3 are rotated 90 degrees about the lamp axis P in the Y-direction as illustrated in FIG. 6C, the first pins 12 make contact with the current-feeding terminal portions 4*b*. This finishes the operation of mounting the alternative lamp 1 to the lamp socket A (see FIG. 4B). At this time, the second pin 13 and the current-feeding terminal portion 5*b* are kept in strong contact with each other by the biasing force of the spring 8. Alternatively, the fluorescent lamp 1' may be mounted to the lamp socket A of the present embodiment. The order of mounting the fluorescent lamp 1' is the same as the mounting order of the alternative lamp 1 and, therefore, will not be described herein.

With the present embodiment, both the alternative lamp 1 and the fluorescent lamp 1' are connectable to the lamp socket A, thereby making it possible to provide the lamp socket A compatible with the alternative lamp 1 and the fluorescent lamp 1'. In this rotary lamp socket A, the alternative lamp 1 or the fluorescent lamp 1' can be mounted by merely rotating the lamp together with the rotor 3. This makes it possible to mount the alternative lamp 1 or the fluorescent lamp 1' with ease. Moreover, the current-feeding terminal 5 to be connected with the second pin 13 is arranged at the rear side of the current-feeding terminals 4 to be connected with the first pins 12 (at the opposite side from the lamp), and the second pin 13 is greater in length than the first pins 12. This makes it possible to prevent the first pins 12 from making contact with the current-feeding terminal portion 5*b* of the current-feeding terminal 5 when the first pins 12 are moved along the insertion grooves (21*f*, 30*a* and 31*b*).

In addition, the outer size of the alternative lamp 1 is set equal to that of the fluorescent lamp 1', and the first pins 12 having the same shape as the lamp pins 12' of the fluorescent lamp 1' are arranged in the same positions as in the end caps 11 of the fluorescent lamp 1'. This makes it possible to easily design the lamp socket A compatible with the fluorescent lamp 1'. Since the lighting current (direct current E) is supplied through the second pins 13 of the end caps 11 of alternative lamp 1, it is possible to make the structure of the lamp socket A common at the left and right sides and to make the alternative lamp 1 symmetrical in shape. This provides an advantage in that the mounting direction of the alternative lamp 1 is not restricted, thereby enhancing the ease of mounting works. The alternative lamp 1 described above is mountable to the lamp socket for the fluorescent lamp 1', but since the first pins 12 of the alternative lamp 1 are not electrically connected to the afore-mentioned printed board, it is possible to prevent the printed board from being adversely affected by the high-frequency current supplied through the first pins 12.

Figure 1B:
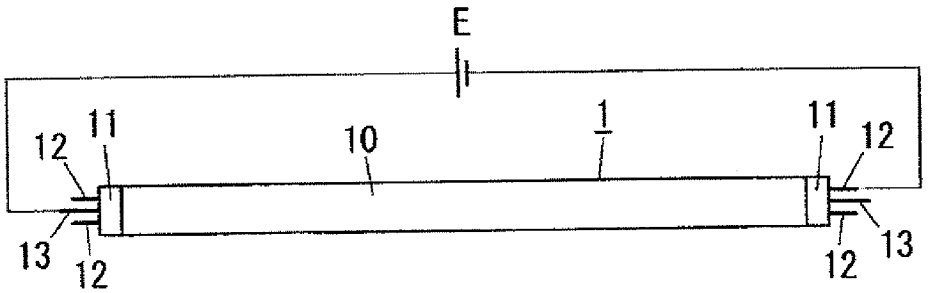
Figure 1C:
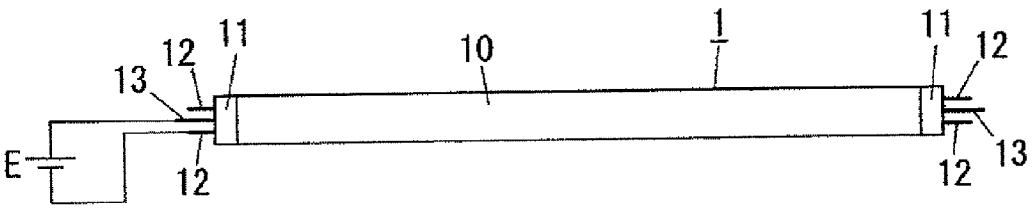

In the present embodiment described above, the lighting current (direct current E) is supplied through the second pins 13 of the end caps 11 arranged in the opposite end portions of the light emitting tube 10 of the alternative lamp 1. In an alternative example, as shown in FIG. 1B, the direct current E may be supplied through the second pin 13 of one of the end caps 11 (the left end cap 11 in FIG. 1B) and the first pin 12 of the other end cap 11. In another alternative example, as shown in FIG. 1C, the direct current E may be supplied through the first pin 12 and the second pin 13 of one of the end caps 11 (the left end cap 11 in FIG. 1C). In this case, it is possible to eliminate the current-feeding path leading to the other end cap 11. This provides an advantage in that the current-feeding path leading to the alternative lamp 1 becomes simple. In the alternative examples shown in FIGS. 1B and 1C, the lighting current is supplied to the alternative lamp 1 or the fluorescent lamp 1' through the use of the same current-feeding terminal 4. Therefore, the electric current supplied to the current-feeding terminals 4 needs to be converted depending on the kind of the connected lamp.

Figure 3:
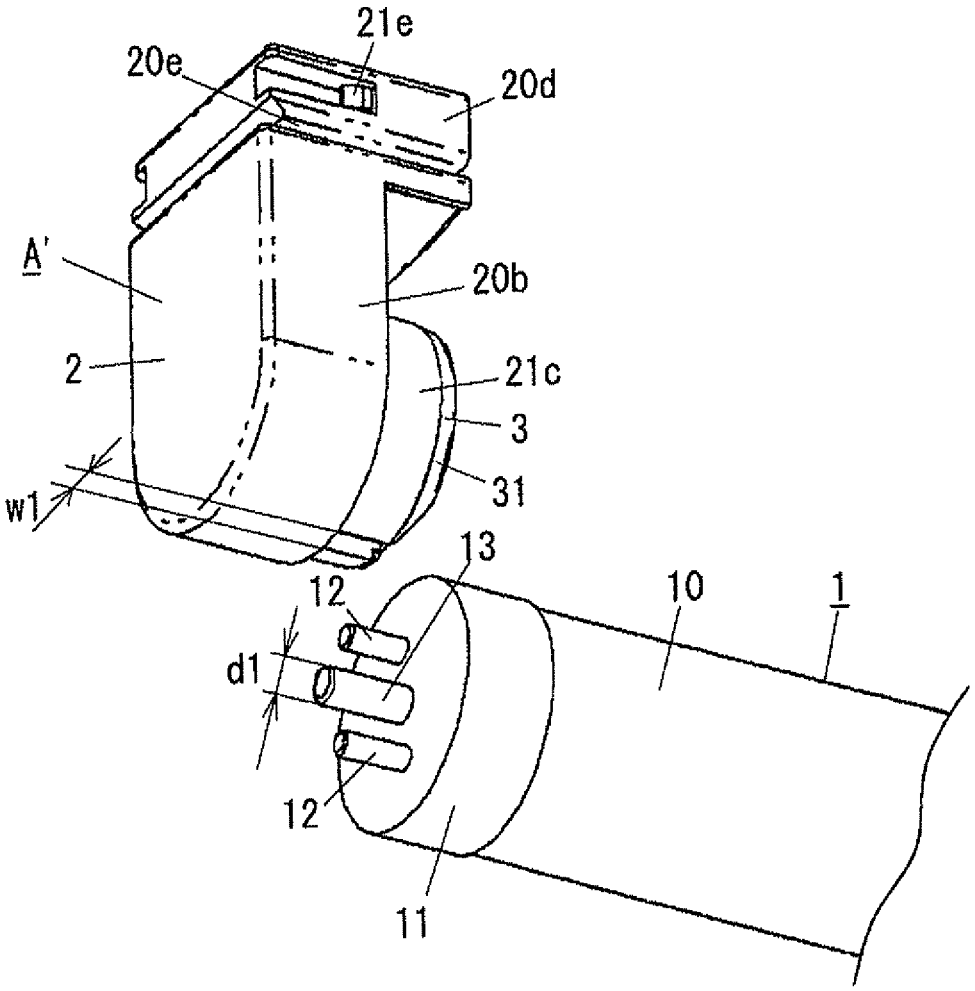
FIG. 3 is a view showing another pin arrangement variation in the alternative lamp.

The lamp socket A' shown in FIG. 3 is a rotary lamp socket for only the fluorescent lamp 1'. In the lamp socket A', the groove width w1 of the insertion groove though which to insert the lamp pins 12' of the fluorescent lamp 1' is set a little greater than the outer diameter of the lamp pins 12'. Therefore, if the outer diameter d1 of the second pin 13 of the alternative lamp 1 is set greater than the groove width w1, the second pin 13 interferes with the insertion groove when one attempts to mount the alternative lamp 1. This makes it possible to prevent the alternative lamp 1 from being erroneously mounted to the lamp socket A'. However, as set forth above, the outer diameter d1 of the second pin 13 needs to be set smaller than the groove width of the insertion grooves (21*f*, 31*b* and 30*a*) of the present lamp socket A. There is no need to increase the outer diameter of the second pin 13 over the full length thereof. It is sufficient if the outer diameter of the second pin 13 is increased at least in a portion of the second pin 13. Interference of the large diameter portion with the insertion groove can prevent any erroneous mounting of the alternative lamp 1 to the lamp socket A'. As shown in FIG. 2A, the first pins 12 and the second pin 13 may not be arranged along a straight line.

Second Embodiment

The lamp socket A according to a second embodiment of the present invention will be described with reference to FIGS. 7A to 8B. While the first embodiment is directed to the rotary lamp socket A, the lamp socket A of the present embodiment is a plunger type. In the following description, the same components as those of the first embodiment will be designated by like reference symbols and redundant description thereof will be omitted.

Figure 7A:
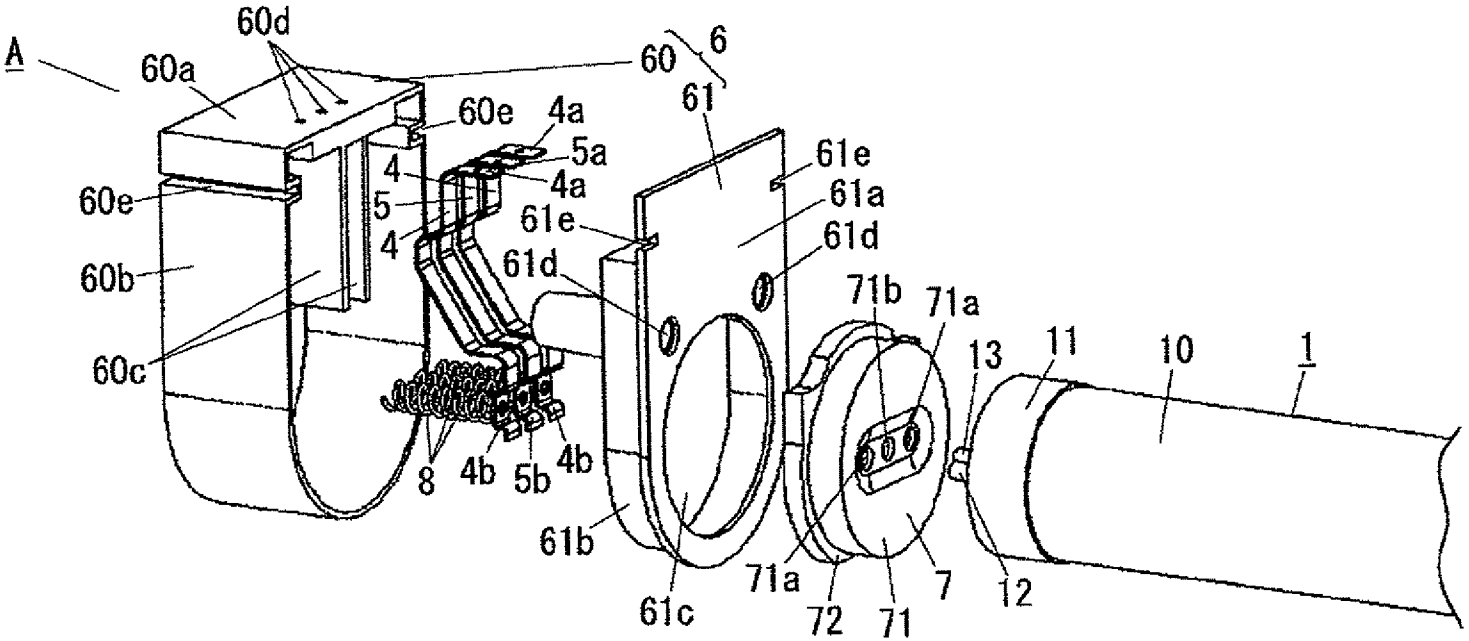
FIG. 7A is an exploded perspective view showing a lamp socket according to a second embodiment of the present invention.

Referring to FIG. 7A, the lamp socket A of the present embodiment includes, as its major components, a socket body 6, a plunger 7, a pair of current-feeding terminals (first current-feeding terminals) 4 and a current-feeding terminal (second current-feeding terminal) 5.

The socket body 6 includes a box-shaped base 60 opened at its front side and a cover 61 attached to the base 60 in such a fashion as to close the front opening of the base 60. The base 60 and the cover 61 are all molded with a synthetic resin.

The base 60 includes an upper wall portion 60*a* having a plurality of (three, in FIG. 7A) wire insertion holes 60*d* into which to insert electric wires (not shown) and insulation wall portions 60*c* extending downwards from the upper wall 60*a* to divide the internal space of the base 60 into three areas along the left-right direction.

The base 60 further includes left and right side wall portions 60*b* having insertion grooves 60*e* extending in the front-rear direction. Ribs (not shown) of a device body 100 (see FIG. 9) are inserted into the insertion grooves 60*e* when the lamp socket A is attached to the device body 100. The base 60 further includes spring retainer portions (not shown) arranged on the bottom surface thereof to retain the rear end portions of a plurality of (three, in FIG. 7A) springs 8. In this regard, the insulation wall portions 60*c* are formed to assure electric insulation between the current-feeding terminals 4 and the current-feeding terminal 5 accommodated within the socket body 6.

The cover 61 includes a flat cover body 61*a* substantially conforming in shape to the front opening of the base 60 and a rib 61*b* integrally formed on the surface of the cover body 61*a* facing the base 60. The rib 61*b* restrains transverse movement and rotational movement of the plunger 7 to be described later. The cover body 61*a* has a circular insertion hole 61*c* into which the plunger 7 is inserted and a pair of screw insertion holes 61*d* into which fastener screws (not shown) for fastening the cover 61 to the base 60 are inserted. The cover body 61*a* further has notches 61*e* defined in alignment with the respective insertion grooves 60*e* of the base 60.

Just like the socket body 6, the plunger 7 is molded with a synthetic resin and includes a disk-shaped plunger body 71 having an outer diameter a little smaller than the insertion hole 61*c* of the cover body 61*a*. The plunger body includes a flange 72 integrally formed at the side thereof facing the base 60. On the front surface (functional surface) of the plunger body 71, there are provided a pair of pin insertion holes 71*a* into which the lamp pins 12' of the fluorescent lamp 1' (see FIG. 9) or the first pins 12 of the alternative lamp 1 (see FIG. 1) are inserted and a pin insertion hole 71*b* into which the second pin 13 of the alternative lamp 1 is inserted. The pin insertion hole 71*b* is arranged between the pin insertion holes 71*a*. The flange 72 makes contact with the edge of the insertion hole 61*c* of the cover body 61*a*, thereby restraining any forward movement of the plunger 7.

Each of the current-feeding terminals 4 is made of an electrically conductive material (e.g., copper) with elasticity and includes a current-receiving terminal portion 4*a* to which each of the electric wires (not shown) inserted into the base 60 through the wire insertion holes 60*d* is electrically connected and a current-feeding terminal portion 4*b* from which a high-frequency current is fed to the fluorescent lamp 1' through the lamp pins 12' of the latter. The current-receiving terminal portion 4*a* and the current-feeding terminal portion 4*b* are bent into a single piece. The current-feeding terminals 4 are arranged at the left and right outer sides of the insulation wall portions 60*c* within the base 60. The current-feeding terminal portions 4*b* are kept biased forwards by the corresponding springs 8, respectively.

Just like the current-feeding terminals 4, the current-feeding terminal 5 is made of an electrically conductive material (e.g., copper) with elasticity and includes a current-receiving terminal portion 5*a* to which the electric wire (not shown) inserted into the base 60 through the wire insertion hole 60*d* is electrically connected and a current-feeding terminal portion 5*b* from which a desired lighting current (e.g., a direct current) is supplied to the alternative lamp 1. The current-receiving terminal portion 5*a* and the current-feeding terminal portion 5*b* are bent into a single piece. The current-feeding terminal 5 is arranged between the insulation wall portions 60*c* within the base 60 to assure electric insulation against the current-feeding terminals 4. The current-feeding terminal portion 5*b* is kept biased forwards by the corresponding spring 8. The electric wires inserted into the socket body 6 through the wire insertion holes 60*d* are connected to the current-receiving terminal portions 4*a* and 5*a* by, e.g., soldering. In the present embodiment, the current-feeding terminals 4, the current-feeding terminal 5 and the plunger 7 make up an end cap receiving unit.

As shown in FIG. 7A, the alternative lamp 1 includes a straight light emitting tube 10 and a pair of end caps 11 provided at the longitudinal opposite end portions of the light emitting tube 10 (only one of the end caps 11 is shown in FIG. 7A). Each of the end caps 11 includes first pins 12 and a second pin 13 arranged in a coaxial relationship with the lamp axis. The first pins 12 and the second pin 13 are arranged side by side along a line orthogonal to the lamp axis.

Next, description will be made on the order of mounting the alternative lamp 1 to the lamp socket A. The first pins 12 and the second pin 13 are inserted into the corresponding pin insertion holes 71*a* and 71*b*, and the end surface of one of the end caps 11 is brought into contact with the front surface of the plunger body 71. If the alternative lamp 1 is pressed rearwards (toward the lamp socket A) in this state, the plunger 7 is moved rearwards against the biasing force of the springs 8. Then, the opposite end cap (not shown) of the alternative lamp 1 is mounted to a lamp socket (not shown) arranged at the opposite side, thereby finishing the process of mounting the alternative lamp 1 to the lamp socket A (see FIG. 7B). Since the current-feeding terminal portions 4*b* and 5*b* are kept biased forwards by the springs 8 at this time, the first pins 12 and the second pin 13 make contact with the current-feeding terminal portions 4*b* and 5*b* under a high contact force.

Figure 7B:
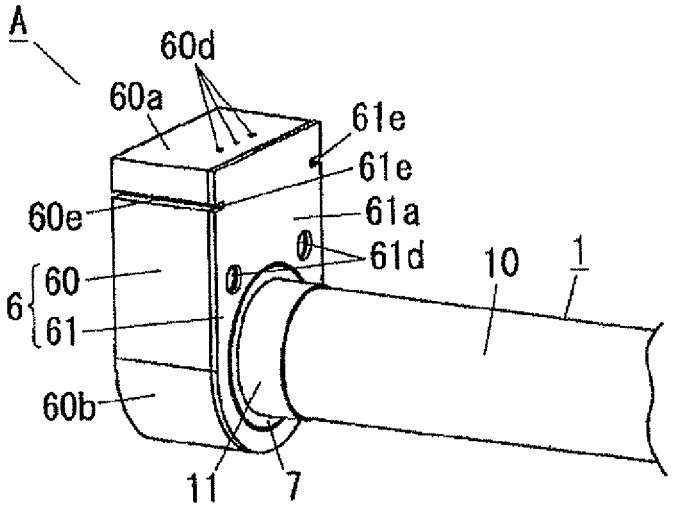
FIG. 7B is a perspective view showing the lamp socket mounted with the alternative lamp.

Subsequently, a modified example of the lamp socket A of the present embodiment will be described with reference to FIGS. 8A and 8B. The lamp socket A described in connection with FIGS. 7A and 7B is mounted with the alternative lamp 1 in which the first pins 12 and the second pin 13 are arranged side by side along a line orthogonal to the lamp axis. In the modified example shown in FIGS. 8A and 8B, the lamp socket A is mounted with an alternative lamp 1 in which the second pin 13 is arranged to protrude in a direction orthogonal to the lamp axis. No description will be made on the same configurations as those shown in FIGS. 7A and 7B.

Figure 8A:
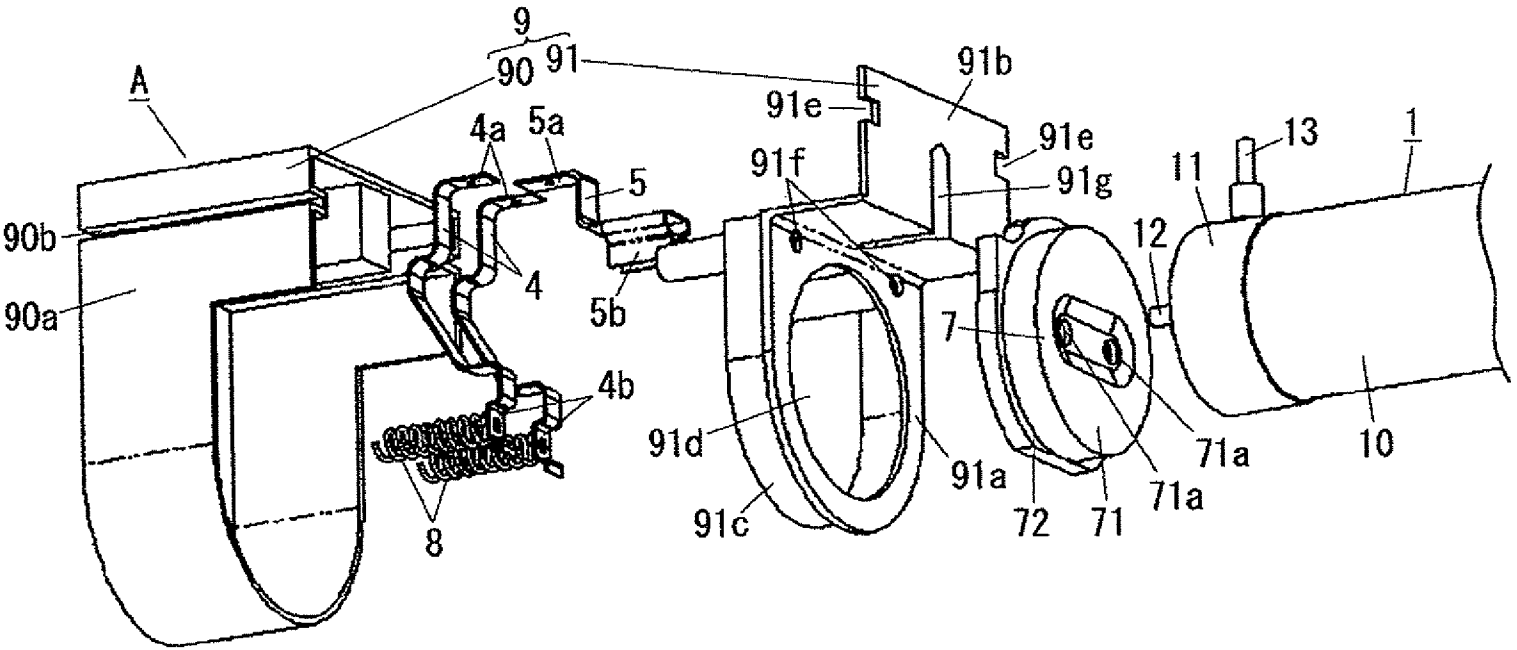
FIG. 8A is an exploded perspective view showing a modified example of the lamp socket.
Figure 8B:
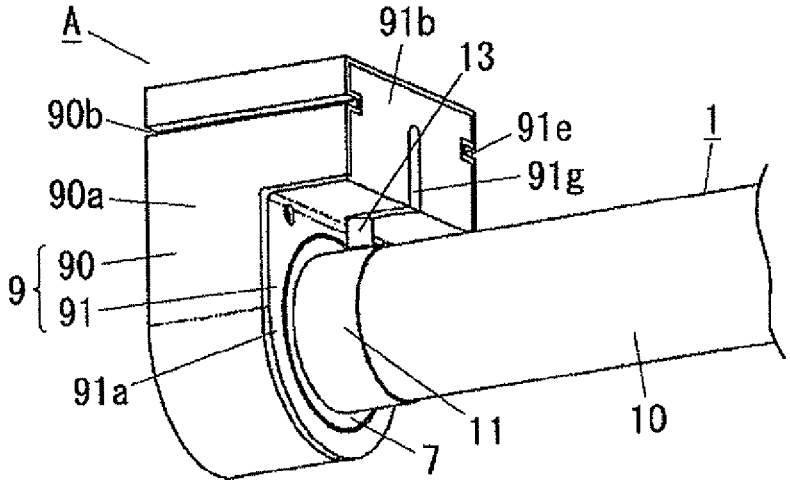
FIG. 8B is a perspective view showing the lamp socket mounted with the alternative lamp.

Referring to FIG. 8A, the lamp socket A of the present modified example includes, as its major components, a socket body 9, a plunger 7, a pair of current-feeding terminals (first current-feeding terminals) 4 and a current-feeding terminal (second current-feeding terminal) 5. The plunger 7 and the current-feeding terminals 4 are the same as those shown in FIG. 7A and, therefore, will not be described herein.

The socket body 9 includes a box-shaped base 90 opened at its front side and a cover 91 attached to the base 90 in such a fashion as to close the front opening of the base 90. The base 90 and the cover 91 are all molded with a synthetic resin.

The base 90 is formed into an L-shaped hollow body when seen in a side view. The upper portion of the base 90 protrudes forwards from the remaining portion. The base 90 includes side wall portions 90*a* having insertion grooves 90*b* extending in the front-rear direction. Ribs (not shown) of a device body 100 (see FIG. 9) are inserted into the insertion grooves 90*b*. The current-feeding terminal 5 to be described later is arranged in the protrusion portion of the base 90. The current-feeding terminal portion 5*b* of the current-feeding terminal 5 is arranged forwards of the current-feeding terminal portions 4*b* of the current-feeding terminals 4.

The cover 91 includes a flat cover body 91*a* for closing the lower front opening of the base 90, a rib 91*c* formed on the surface of the cover body 91*a* facing the base 90 to restrain transverse movement and rotational movement of the plunger 7, and an L-shaped projection 91*b* integrally formed with the upper portion of the cover body 91*a* for closing the front opening of the protrusion portion of the base 90. The cover body 91*a* has a circular insertion hole 91*d* into which the plunger 7 is inserted and a pair of screw insertion holes 91*f* into which fastener screws (not shown) for fastening the cover 91 to the base 90 are inserted. The projection 91*b* includes a horizontal portion and a vertical portion. A pin insertion slot 91*g* is defined to extend across the horizontal portion and the vertical portion. The vertical portion of the projection 91*b* has notches 91*e* defined in alignment with the respective insertion grooves 90*b* of the base 90.

The current-feeding terminal 5 is made of an electrically conductive material (e.g., copper) with elasticity and includes a current-receiving terminal portion 5*a* to which the electric wire inserted into the base 90 through the wire insertion hole (not shown) is electrically connected and a current-feeding terminal portion 5*b* making contact with the second pin 13 to supply a desired lighting current to the alternative lamp 1. The current-receiving terminal portion 5*a* and the current-feeding terminal portion 5*b* are bent into a single piece. The current-feeding terminal 5 is arranged in the protrusion portion of the base 90 so that the current-feeding terminal portion 5*b* can face the pin insertion slot 91*g*.

Figure 2D:
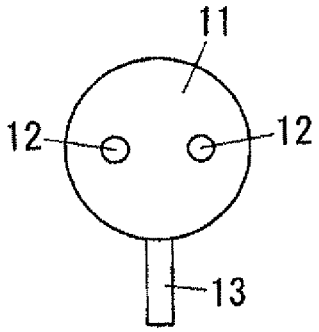

As shown in FIG. 8A, the alternative lamp 1 includes a straight light emitting tube 10 and a pair of end caps 11 provided at the longitudinal opposite end portions of the light emitting tube 10 (only one of the end caps 11 is shown in FIG. 8A). Each of the end caps 11 includes first pins 12 arranged to protrude in the direction of the lamp axis and a second pin 13 arranged to protrude in the direction orthogonal to the lamp axis. In other words, the first pins 12 and the second pin 13 of the present alternative lamp 1 are arranged to protrude in a mutually orthogonal direction (see FIG. 2D).

Next, description will be made on the order of mounting the alternative lamp 1 to the lamp socket A. The alternative lamp 1 is oriented so that the second pin 13 protrudes upwards. Thereafter, the first pins 12 are inserted into the corresponding pin insertion holes 71*a* and the second pin 13 is inserted into the pin insertion slot 91*g*, thereby bringing the end surface of one of the end caps 11 into contact with the front surface of the plunger body 71. If the alternative lamp 1 is pressed rearwards (toward the lamp socket A) in this state, the plunger 7 is moved rearwards against the biasing force of the springs 8. Then, the opposite end cap (not shown) of the alternative lamp 1 is mounted to a lamp socket (not shown) arranged at the opposite side, thereby finishing the process of mounting the alternative lamp 1 to the lamp socket A (see FIG. 8B). At this time, the first pins 12 make contact with the current-feeding terminal portions 4*b*, and second pin 13 comes into contact with the current-feeding terminal portion 5*b*.

With the present embodiment, use of the plunger-type lamp socket A allows the alternative lamp 1 or the fluorescent lamp 1' to move only in the direction parallel to the lamp axis. As compared with the rotary lamp socket, the plunger-type lamp socket A provides an advantage in that the degree of freedom in arranging the second pin 13 grows higher. Moreover, the alternative lamp 1 or the fluorescent lamp 1' can be mounted by merely moving the lamp in the direction parallel to the lamp axis. This makes it possible to mount the alternative lamp 1 or the fluorescent lamp 1' with ease. It is sufficient if the pin insertion slot 91*g* for insertion of the second pin 13 is provided in the lamp socket A. This assists in reducing the influence on the lamp socket A.

If the second pin 13 is arranged to protrude in the direction orthogonal to the lamp axis as in the alternative lamp 1 shown in FIG. 8A, the second pin 13 is kept in a position separated from the first pins 12. As a result, it is possible to secure insulation distance between the first pins 12 and the second pin 13 when an electric current is fed through the first pins 12 and the second pin 13. This provides an advantage in that it is possible to assure increased safety.

The arrangement of the first pins 12 and the second pin 13 is not limited to the present embodiment but may be suitably designed in conformity with the shape of the lamp socket A or the like.

In the first and second embodiments described above, the second pin 13 is provided in each of the end caps 11, which is desirable in view of the ease of installation. Alternatively, the second pin 13 may be provided in only one of the end caps 11, in which case an electric current may be fed through the second pin 13 and one of the first pins 12. At this time, the second pin 13 of one of the end caps 11 and the first pin 12 of the other end cap 11 may be used in feeding the electric current, or the first pin 12 and the second pin 13 of the same end cap 11 may be used for that purpose. If the first pin 12 and the second pin 13 of the same end cap 11 are used, the current-feeding path of the other end cap 11 becomes unnecessary. This provides an advantage in that the current-feeding path leading to the alternative lamp 1 is made simple. While the alternative lamp 1 described in respect of the first and second embodiments is an LED lamp having LEDs as its light source, the alternative lamp 1 is not limited to the LED lamp but may be other lamps. In this case, the lighting current corresponding to the lamp in use may be supplied through the current-feeding terminal 4 or 5.

Third Embodiment

An illumination device according to a third embodiment of the present invention, i.e., an illumination device B for use with the lamp socket A described in respect of the first and second embodiments, will now be described with reference to FIGS. 9 and 10.

Figure 9:
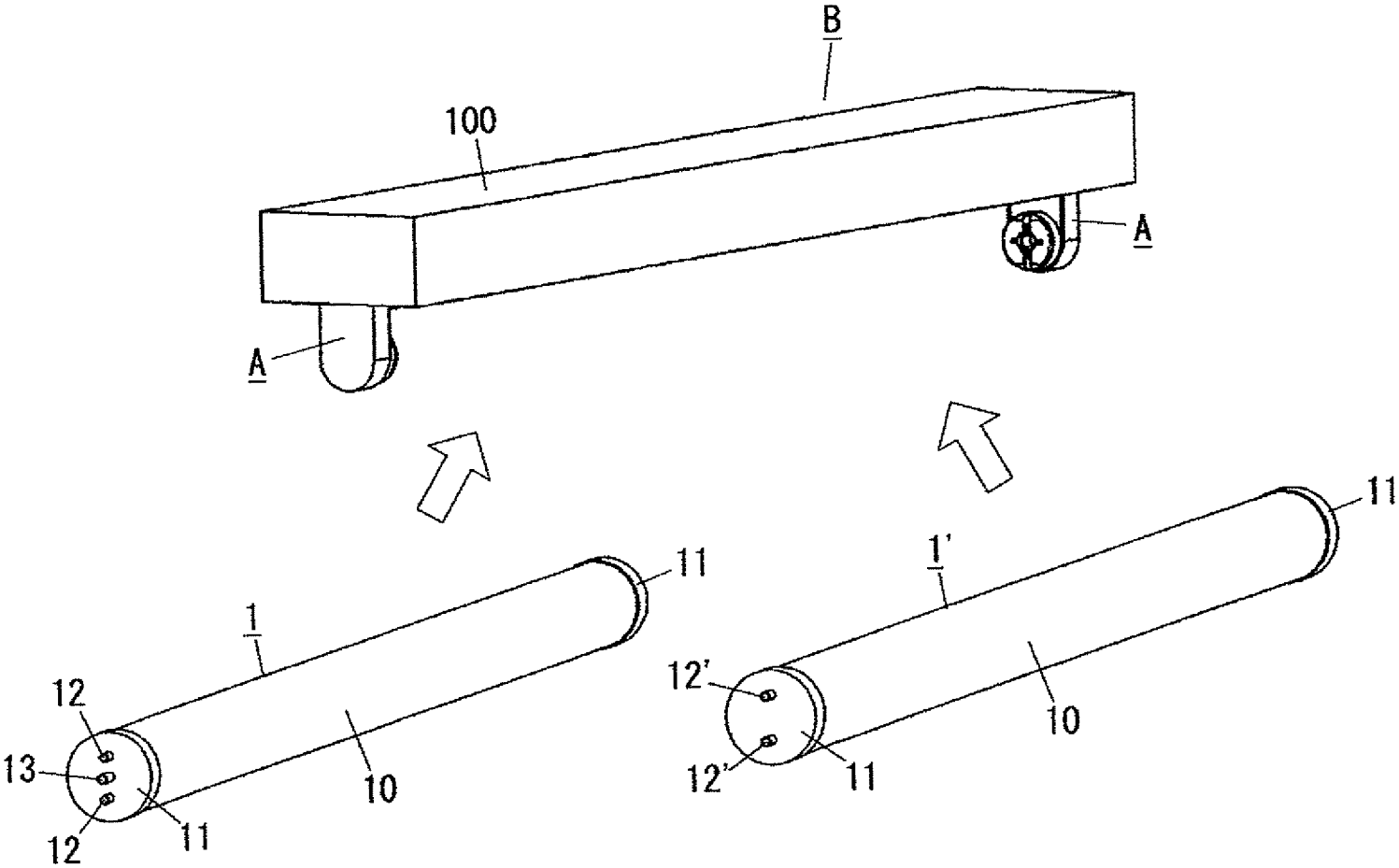
FIG. 9 is a perspective view showing an illumination device according to a third embodiment of the present invention, to which the lamp is not mounted.
Figure 10:
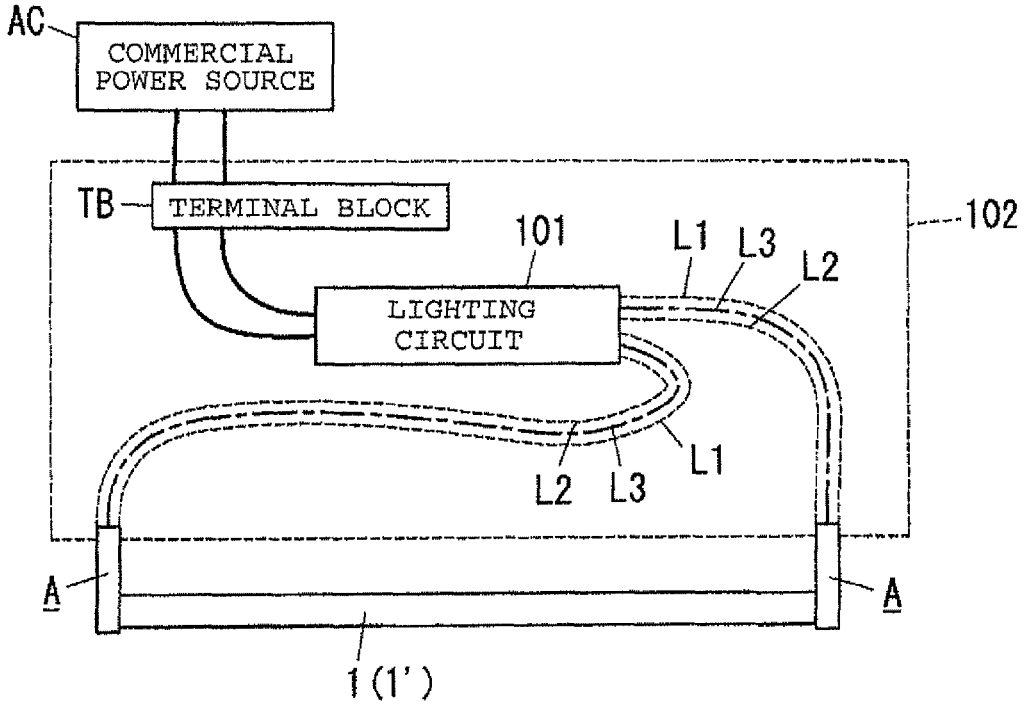
FIG. 10 is a schematic configuration diagram of the illumination device shown in FIG. 9.

Referring to FIG. 9, the illumination device B of the present embodiment includes a pair of lamp sockets A to which one of the alternative lamp 1 and the fluorescent lamp 1' is mounted and a rectangular box-shaped device body 100 to which the lamp sockets A are attached with their functional surfaces facing one another. A lighting device 102 is built in the device body 100. As shown in FIG. 10, the lighting device 102 includes a lighting circuit 101 and a terminal block TB arranged to interconnect the lighting circuit 101 and the commercial power source AC. The lighting circuit 101 includes, e.g., an inverter circuit for generating a high-frequency current to be supplied to the fluorescent lamp 1' and a direct current supply circuit for generating a direct current to be supplied to the alternative lamp 1 having LEDs as its light source. The high-frequency current outputted from the lighting circuit 101 is supplied to the respective lamp sockets A through current-feeding lines L1 and L2. The direct current outputted from the lighting circuit 101 is supplied to the respective lamp sockets A through a current-feeding line L3.

Since the lamp socket A described above is used in the present embodiment, it is possible to provide an illumination device B compatible with both the alternative lamp 1 and the fluorescent lamp 1'. Inasmuch as either of the lamps 1 and 1' is mountable to the illumination device B, the illumination device B can be differently used depending on the use thereof.

The lamp socket A used in the present illumination device B is not limited to the rotary type shown in FIG. 9 but may be the plunger type shown in FIGS. 7A to 8B. The alternative lamp 1 may be appropriately selected in conformity with the kind of the lamp socket A used.

Fourth Embodiment

Figure 11A:
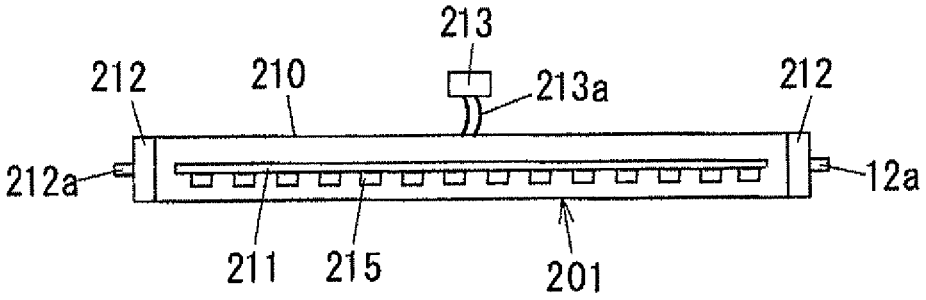
FIG. 11A is a schematic view showing an LED lamp employed in an illumination device according to a fourth embodiment of the present invention.
Figure 11B:
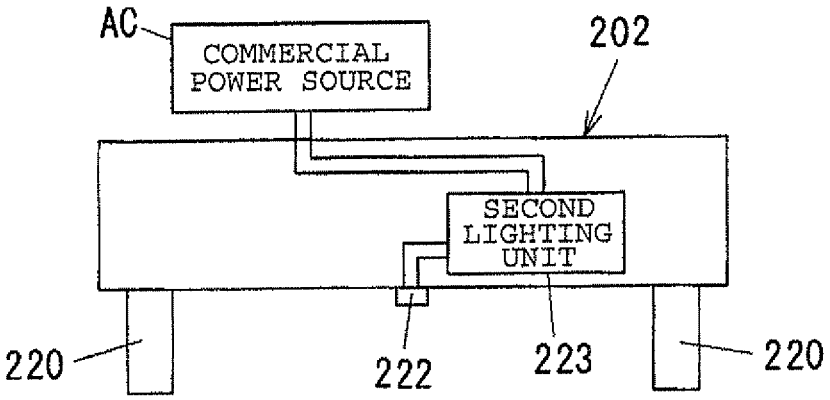
FIG. 11B is a schematic view showing a device body employed in the illumination device.

Next, an illumination device according to a fourth embodiment of the present invention will be described with reference to FIGS. 11A to 12B. In the following description, the direction running toward the upper and lower sides in FIG. 11A will be defined as an up-down direction. Referring to FIGS. 11A and 11B, the illumination device of the present embodiment includes a device body 202 and a pair of sockets 220 held by the device body 202. A pair of end caps 212 or 230 arranged in the longitudinal opposite end portions of an LED lamp 201 (or a light source) or a fluorescent lamp 203 (see FIG. 12A) is mounted to the sockets 220.

As shown in FIG. 11A, the LED lamp 201 includes a straight tubular body 210 and a flat elongated substrate 211 accommodated within the tubular body 210. The substrate 211 is provided with a light-emitting unit including a plurality of light-emitting diodes 215. Arranged in the longitudinal opposite end portions of the tubular body 210 are the end caps 212 mounted to the sockets 220. A pair of circular rod-shaped dummy pins 212*a* protrudes from the end caps 212. In this regard, the end caps 212 and the dummy pins 212*a* are merely configured for attachment to the sockets 220 and are electrically insulated from the substrate 211. Therefore, even if the LED lamp 201 is mounted to the sockets 220, there is no possibility that an electric current is fed to the light-emitting unit through the end caps 212 and the dummy pins 212*a*.

Figure 12A:
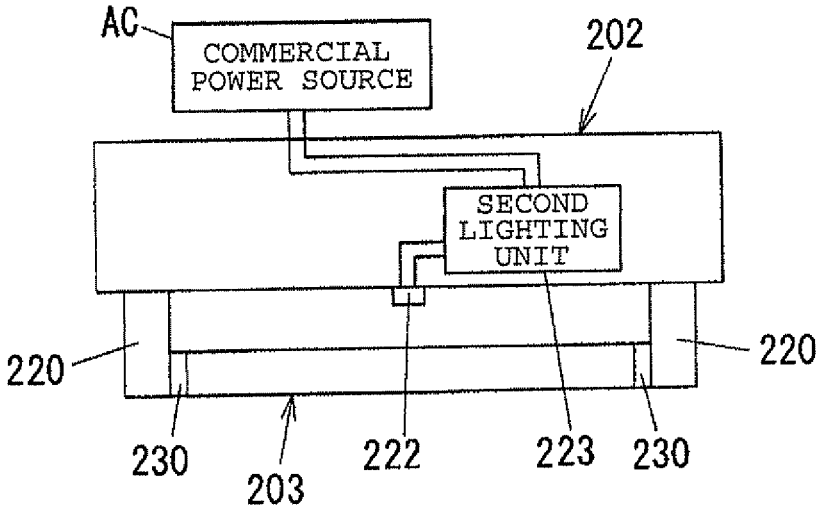
FIG. 12A is a schematic view of the illumination device mounted with a fluorescent lamp.
Figure 12B:
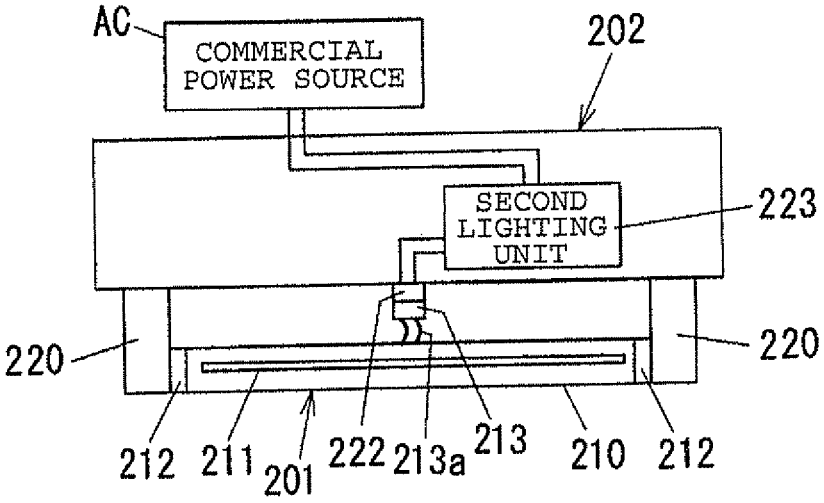
FIG. 12B is a schematic view of the illumination device mounted with an LED lamp.

The light-emitting diodes 215 are fixed to the lower surface of the substrate 211 so that they can emit light downwards when the LED lamp 201 is mounted to the sockets 220. Wiring lines (not shown) for connecting the light-emitting diodes 215 in series, in parallel or in combination thereof are arranged on the upper and lower surfaces of the substrate 211. A current-feeding unit 213 electrically connected to the wiring lines are positioned in the middle portion of the tubular body 210 between the end caps 212. The current-feeding unit 213 includes a connector coupled with the below-mentioned connection portion 222 of the device body 202. The current-feeding unit 213 is electrically connected to the wiring lines of the substrate 211 through a cable 213*a* extending through the tubular body 210. As shown in FIG. 12B, the current-feeding unit 213 is arranged so that it can be positioned at the upper side of the LED lamp 201 (namely, the side facing the device body 202) when the end caps 212 are mounted to the sockets 220 as illustrated in FIG. 12B.

As can be seen in FIG. 11B, the device body 202 is formed into an elongated box shape to extend along the longitudinal direction of the LED lamp 201 or the fluorescent lamp 203. Within the device body 202, there is arranged a first lighting unit 221 (see FIG. 13A) for supplying a lighting current to the fluorescent lamp 203 or a second lighting unit 223 for supplying a lighting current to the LED lamp 201. In this regard, the device body 202 of the present embodiment is obtained by remodeling the existing illumination device for fluorescent lamps. It is assumed that the first lighting unit 221 is removed from the device body 202 and, instead, the second lighting unit 223 is arranged within the device body 202. On the lower surface of the device body 202, there is arranged a connection unit 222 including a connector to which the current-feeding unit 213 is attached. By attaching the current-feeding unit 213 to the connection unit 222, there is established a current-feeding path extending from the second lighting unit 223 to the LED lamp 201 through the connection unit 222 and the current-feeding unit 213.

The sockets 220 are arranged at the longitudinal opposite ends of the lower surface of the device body 202. The sockets 220 are of the type used in the existing illumination device for fluorescent lamps. Arranged within the sockets 220 are conductor terminals (not shown) for mechanically holding the lamp pins (not shown) protruding from the end caps 230 of the fluorescent lamp 203 and for electrically interconnecting the first lighting unit 221 and the fluorescent lamp 203. As set forth above, the first lighting unit 221 is not arranged within the device body 202 in the present embodiment. The conductor terminals of the sockets 220 and the second lighting unit 223 are not electrically connected to each other.

A method of mounting the LED lamp 201 and the fluorescent lamp 203 to the illumination device of the present embodiment will now be described with reference to FIGS. 12A and 12B. First, description will be made on how to mount the fluorescent lamp 203 to the sockets 220. If the end caps 230 of the fluorescent lamp 203 are mounted to the sockets 220 as illustrated in FIG. 12A, the lamp pins of the fluorescent lamp 203 are mechanically held by the conductor terminals of the sockets 220. However, no electric current is supplied to the fluorescent lamp 203 because the conductor terminals and the second lighting unit 223 are not connected to each other.

Next, description will be made on how to mount the LED lamp 201 to the sockets 220. If the end caps 212 of the LED lamp 201 are mounted to the sockets 220 as illustrated in FIG. 12B, the dummy pins 212*a* of the LED lamp 201 are mechanically held by the conductor terminals of the sockets 220. Thus, the sockets 220 hold the LED lamp 201 in place. If the current-feeding unit 213 of the LED lamp 201 is connected to the connection unit 222 of the device body 202, there is established a current-feeding path extending from the second lighting unit 223 to the LED lamp 201 through the current-feeding unit 213 and the connection unit 222. Consequently, a lighting current is supplied from the second lighting unit 223 to the LED lamp 201, thereby turning on the LED lamp 201.

In a configuration that a lighting current is supplied from the second lighting unit 223 to the LED lamp 201 through the sockets 220, the second lighting unit 223 and the fluorescent lamp 203 may be electrically connected to each other through the sockets 220 if the fluorescent lamp 203 is inadvertently mounted to the sockets 220. In this case, the fluorescent lamp 203 cannot be turned on and may be adversely affected. In the present embodiment, however, the LED lamp 201 and the second lighting unit 223 are electrically connected to each other via the current-feeding path passing through the current-feeding unit 213 and the connection unit 222 and not the conventional current-feeding path passing through the sockets 220. Therefore, even if the fluorescent lamp 203 is inadvertently mounted to the sockets 220, there is no possibility that the second lighting unit 223 and the fluorescent lamp 203 are electrically connected to each other through the sockets 220.

As described above, the LED lamp 201 of the present embodiment includes the end caps 212 mountable to the sockets 220 of the existing illumination device for fluorescent lamps and the current-feeding unit 213 for feeding an electric current to the LED lamp 201 via the current-feeding path differing from the current-feeding path passing through the sockets 220. Thanks to this feature, the LED lamp 201 of the present embodiment can be mounted to the sockets 220 of the existing illumination device for fluorescent lamps and are stably held in the device body 202 just like the fluorescent lamp 203. Since no electric current is supplied via the current-feeding path passing through the sockets 220 when the LED lamp 201 is mounted to the sockets 220, the fluorescent lamp 203 and other light sources may be interchangeably used with ease without having to replace the lamp socket while maintaining stable current-feeding performance. Even when the end caps 212 are detached from the sockets 220, it is possible to prevent drop of the LED lamp 201. This is because the current-feeding unit 213 remains attached to the connection unit 222.

In the present embodiment, the current-feeding unit 213 is arranged so that it can be positioned near the device body 202 when the end caps 212 are mounted to the sockets 220. Thus, the current-feeding unit 213 is hidden by the substrate 211. Accordingly, the current-feeding unit 213 does not impair the outward appearance of the illumination device nor hinder the light distribution of the light-emitting diodes 215 (the light-emitting unit). Since the current-feeding unit 213 of the present embodiment is arranged in the middle portion of the device body 202 between the end caps 212, it is possible to mount the LED lamp 201 regardless of the direction thereof. Assuming that the current-feeding unit 213 is arranged in a position deviated from the middle portion between the end caps 212, the mounting direction of the LED lamp 201 is confined to a single direction. If the current-feeding unit 213 is arranged in the middle portion between the end caps 212, the LED lamp 201 can be easily mounted regardless of the direction thereof.

In addition, the tubular body 210 of the LED lamp 201 of the present embodiment has the same shape as the conventional fluorescent lamp 203 and includes the end caps 212 attached to the longitudinal opposite ends thereof. This makes it possible to mount the LED lamp 201 to the sockets 220 in the same manner as applied to the conventional straight tubular fluorescent lamp 203. Inasmuch as the conventional fluorescent lamp 203 and the LED lamp 201 of the present embodiment have the same outward appearance, the overall appearance of the illumination device remains unchanged when the fluorescent lamp 203 is replaced with the LED lamp 201.

Figure 13A:
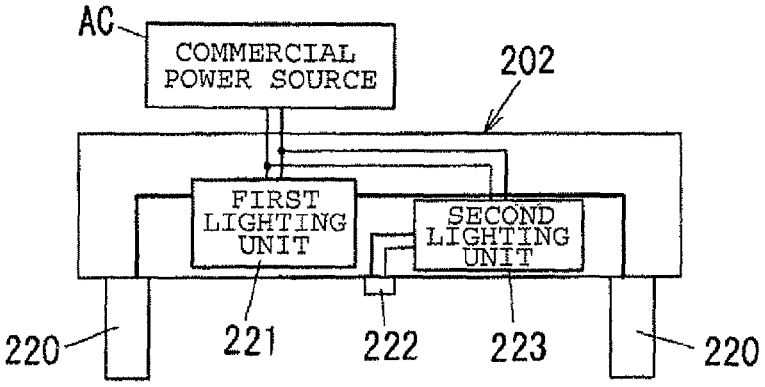
FIG. 13A is a schematic view showing a device body in a modified example of the illumination device.
Figure 13B:
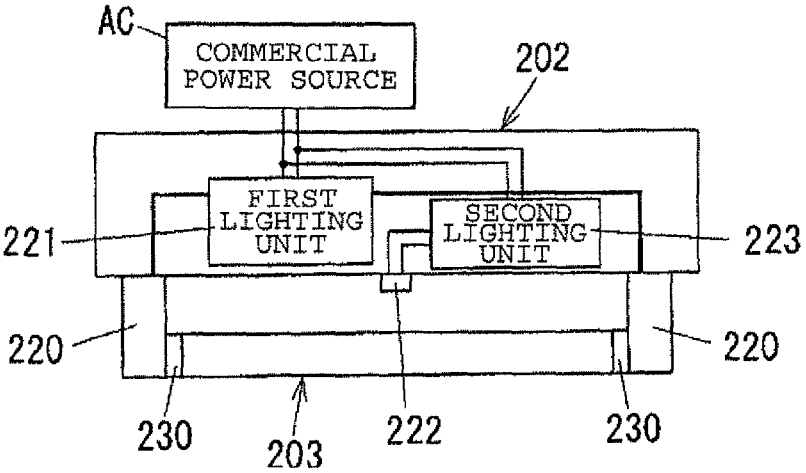
FIG. 13B is a schematic view showing the illumination device in which a fluorescent lamp is mounted to the socket.
Figure 13C:
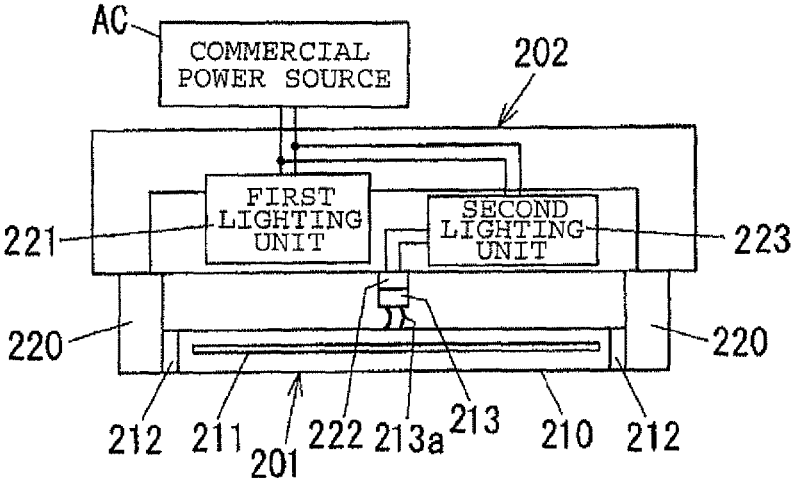
FIG. 13C is a schematic view showing the illumination device in which an LED lamp is mounted to the socket.

While only the second lighting unit 223 for the LED lamp 201 is arranged within the device body 202 in the present embodiment, the first lighting unit 221 for the fluorescent lamp 203 may also be positioned within the device body 202 as shown in FIG. 13A. In this case, if the fluorescent lamp 203 is mounted to the sockets 220 as shown in FIG. 13B, a lighting current is fed from the first lighting unit 221 to the fluorescent lamp 203 through the sockets 220, thereby turning on the fluorescent lamp 203. If the LED lamp 201 is mounted to the sockets 220 with the current-feeding unit 213 attached to the connection unit 222 as shown in FIG. 13C, a lighting current is fed from the second lighting unit 223 to the LED lamp 201 through the current-feeding unit 213 and the connection unit 222, thereby turning on the LED lamp 201. Therefore, the lighting current is fed via different current-feeding paths when either of the LED lamp 201 and the fluorescent lamp 203 is mounted to the sockets 220. This makes it possible to selectively use the LED lamp 201 and the fluorescent lamp 203 at the user's desire. Since the kind of the lamp mounted to the sockets 220 does not matter, even if an unwanted lamp is inadvertently mounted to the sockets 220, the lamp is turned on and is not adversely affected.

Fifth Embodiment

Figure 14A:
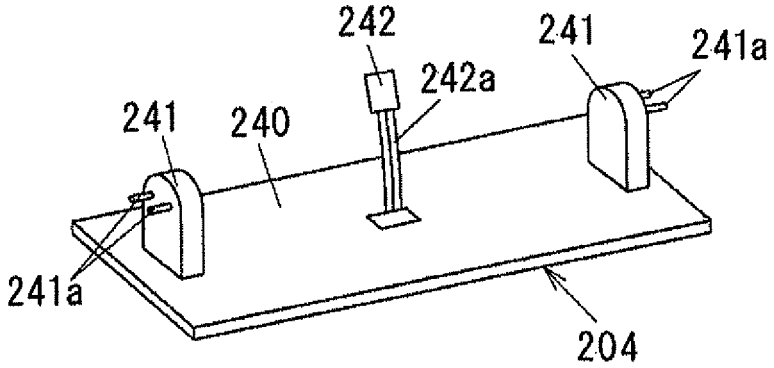
FIG. 14A is a perspective view showing an LED lamp employed in an illumination device according to a fifth embodiment of the present invention.
Figure 14B:
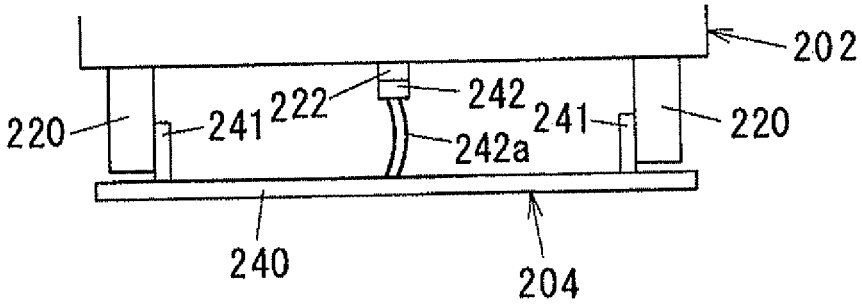
FIG. 14B is a schematic view showing the illumination device in which the LED lamp is mounted to the socket.

Next, an illumination device according to a fifth embodiment of the present invention will be described with reference to FIGS. 14A and 14B. The basic configuration of the present embodiment is essentially the same as the configuration of the fourth embodiment. Therefore, the same components are designated by like reference symbols and will not be described in detail. In the following description, the direction running toward the upper and lower sides in FIG. 14B will be defined as an up-down direction. As can be seen in FIG. 14A, the present embodiment differs from the fourth embodiment in the configuration of an LED lamp 204 (or a light source).

Referring to FIG. 14A, the LED lamp 204 includes an elongated flat substrate 240 provided with light-emitting diodes (not shown) and a pair of end caps 241 arranged at the longitudinal opposite ends of the upper surface of the substrate 240 so that they can be mounted to the sockets 220. However, the LED lamp 204 does not include the tubular body 210 employed in the fourth embodiment. As in the fourth embodiment, the end caps 241 include a pair of circular rod-shaped dummy pins 241*a* protruding from each of the end caps 241. A current-feeding unit 242 is arranged on the upper surface of the substrate 240 in the middle portion between the end caps 241.

The light-emitting diodes are fixed to the lower surface of the substrate 240 so that they can emit light downwards when the LED lamp 204 is mounted to the sockets 220. Wiring lines (not shown) for connecting the light-emitting diodes in series, in parallel or in combination thereof are arranged on the upper and lower surfaces of the substrate 240. As in the fourth embodiment, the current-feeding unit 242 includes a connector and is electrically connected to the wiring lines of the substrate 240 through a cable 242*a*.

A method of mounting the LED lamp 204 of the present embodiment will now be described with reference to FIG. 14B. If the end caps 241 are mounted to the sockets 220 as illustrated in FIG. 14B, the LED lamp 204 is held in the sockets 220. Then, if the current-feeding unit 242 is attached to the connection unit 222, there is established a current-feeding path extending from the second lighting unit 223 to the LED lamp 204. Thus, a lighting current is fed to the LED lamp 204, thereby turning on the LED lamp 204. In the present embodiment, the end caps 241 are arranged on the upper surface of the substrate 240. Therefore, if the end caps 241 are mounted to the sockets 220, the substrate 240 protrudes downwards (outwards) beyond the sockets 220. In other words, the light-emitting unit of the substrate 240 is positioned downward of the sockets 220.

In case of the fourth embodiment, the substrate 211 is arranged within the tubular body 210 and the dimension of the tubular body 210 is confined to the distance between the sockets 220. This restricts the dimension of the substrate 211, consequently making it impossible to freely design the light-emitting unit. In the present embodiment, however, the substrate 240 is positioned downward of the sockets 220. This means that the dimension of the substrate 240 is not confined to the distance between the sockets 220. Accordingly, it is possible to freely design the substrate 240 into a rectangular plate shape, a disk shape or other shapes. This makes it possible to design the light-emitting unit into a shape differing from the shape of the fluorescent lamp 203. The sockets 220, when seen from below, are hidden by the substrate 240, which assists in improving the outward appearance of the illumination device.

Sixth Embodiment

Figure 15A:
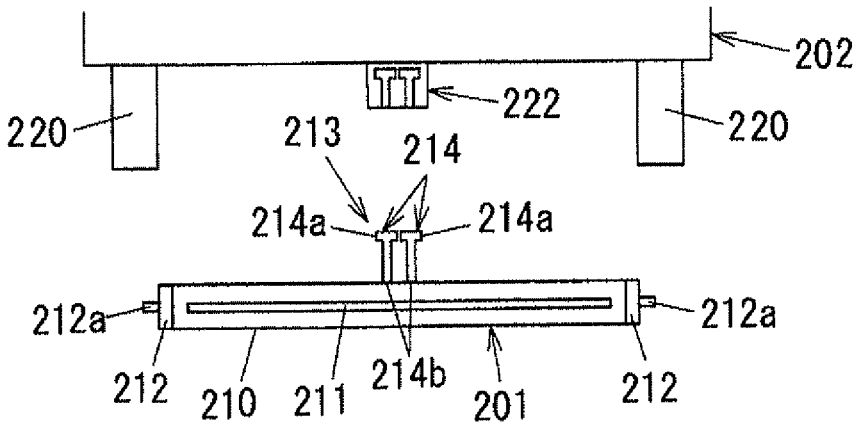
FIG. 15A is an overall schematic view showing an illumination device according to a sixth embodiment of the present invention.
Figure 15B:
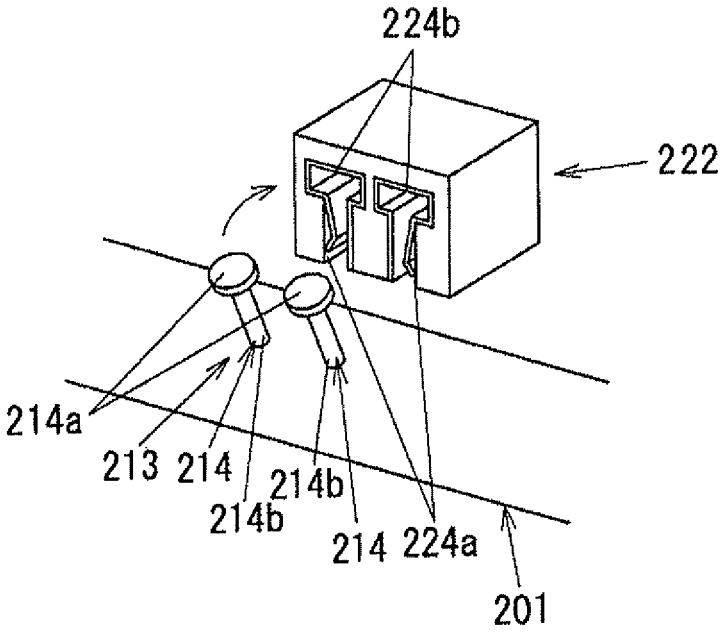
FIG. 15B is a perspective view showing major components of the illumination device.

Next, an illumination device according to a sixth embodiment of the present invention will be described with reference to FIGS. 15A and 15B. The basic configuration of the present embodiment is essentially the same as the configuration of the fourth embodiment. Therefore, the same components are designated by like reference symbols and will not be described in detail. In the following description, the direction running toward the upper and lower sides in FIG. 15A will be defined as an up-down direction. As can be seen in FIG. 15A, the current-feeding unit 213 of the LED lamp 201 includes a pair of current-feeding terminals 214. As shown in FIG. 15B, the connection unit 222 of the device body 202 includes a pair of insertion grooves 224*a* into which the current-feeding terminals 214 are inserted and a pair of conductor plates 224*b* arranged on the inner peripheral surfaces of the insertion grooves 224*a*.

Each of the current-feeding terminals 214 is made of an electrically conductive material and includes a disk-shaped head portion 214*a* and a circular rod-shaped shaft portion 214*b*, both of which are integrally formed into a substantially T-shaped cross section. The current-feeding terminals 214 are arranged to protrude from the upper surface of the substrate 211 through the tubular body 210 and are electrically connected to the wiring lines of the substrate 211. The connection unit 222 is formed into a box-shaped overall shape and is provided with a pair of insertion grooves 224*a* of substantially T-shaped cross section into which the current-feeding terminals 214 are inserted. Conductor plates 224*b* electrically connected to the current-feeding terminals 214 are arranged inside the insertion grooves 224*a* to extend along the inner peripheral surfaces of the insertion grooves 224*a*. The conductor plates 224*b* are electrically connected to the second lighting unit 223. Thus, if the current-feeding terminals 214 and the conductor plates 224*b* are brought into contact with each other and electrically connected to one another, there is established a current-feeding path extending from the second lighting unit 223 to the LED lamp 201 through the current-feeding terminals 214 and the conductor plates 224*b*.

In this regard, if the current-feeding terminals 214 are inserted into the insertion grooves 224*a*, the head portions 214*a* of the current-feeding terminals 214 are caught by the inner surfaces of the conductor plates 224*b*, thereby preventing the current-feeding terminals 214 from moving in the gravitational direction. That is to say, the current-feeding terminals 214 of the current-feeding unit 213 and the conductor plates 224*b* of the connection unit 222 serve as a holder unit for mechanically holding themselves.

A method of mounting the LED lamp 201 of the present embodiment will now be described with reference to FIGS. 16A to 16C. The sockets 220 of the present embodiment include slits (not shown) into which the dummy pins 212*a* of the LED lamp 201 or the lamp pins of the fluorescent lamp 203 are inserted in the direction perpendicular to the lamp axis. The LED lamp 201 or the fluorescent lamp 203 can be mounted to the sockets 220 by rotating the lamp at an angle of 90° about its axis in a state that the dummy pins 212*a* or the lamp pins are inserted into the corresponding slits. The sockets 220 of the present embodiment are of a rotary type.

Figure 16A:
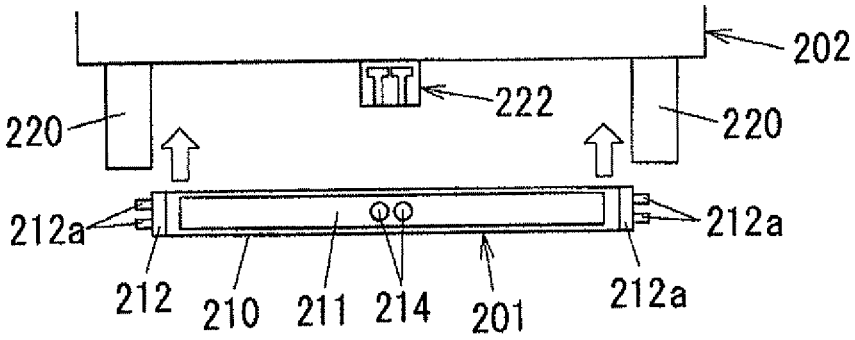
FIGS. 16A through 16C are views explaining how to mount the LED lamp to the socket of the illumination device.
Figure 16B:
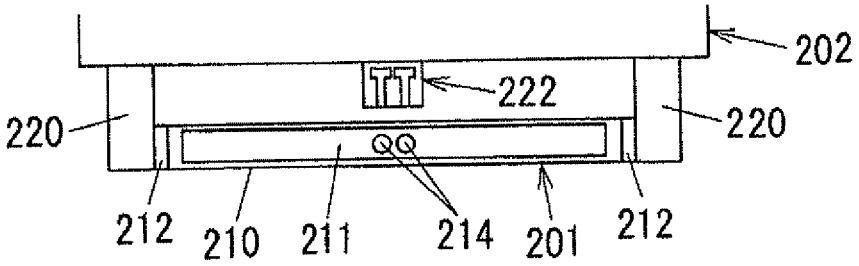
Figure 16C:
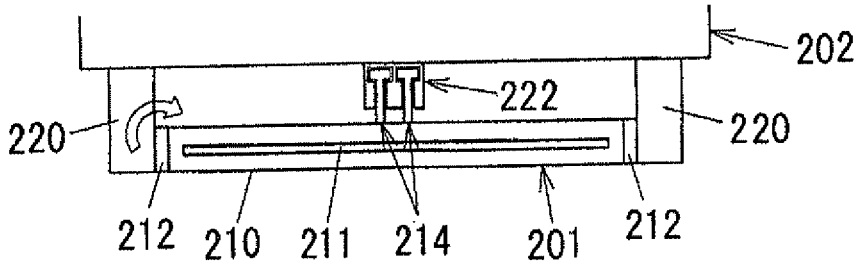

As shown in FIG. 16A, the dummy pins 212*a* of the end caps 212 of the LED lamp 201 are first inserted into the sockets 220. At this time point, the current-feeding terminals 214 are kept rotated 90 degrees counterclockwise about the axis of the LED lamp 201 away from the connection unit 222. Thereafter, if the LED lamp 201 is rotated 90 degrees about its axis as shown in FIGS. 16B and 16C, the end caps 212 are mounted to the corresponding sockets 220.

Upon rotating the LED lamp 201 in this manner, the current-feeding terminals 214 are rotated together and guided into the insertion grooves 224*a* of the connection unit 222. As a result, the head portions 214*a* of the current-feeding terminals 214 are caught by the inner surfaces of the conductor plates 224*b* whereby the current-feeding terminals 214 are mechanically held by the conductor plates 224*b*. At the same time, the current-feeding terminals 214 and the conductor plates 224*b* are brought into contact with each other and electrically connected to one another. This establishes a current-feeding path extending from the second lighting unit 223 to the LED lamp 201 through the current-feeding terminals 214 and the conductor plates 224*b*. Consequently, a lighting current is fed from the second lighting unit 223 to the LED lamp 201, thereby turning on the LED lamp 201.

In the present embodiment described above, the current-feeding unit 213 is attached to the connection unit 222 simultaneously with the end caps 212 being mounted to the sockets 220. Therefore, the task of mounting the LED lamp 201 to the sockets 220 and the task of attaching the current-feeding unit 213 to the connection unit 222 can be carried out through a single operation, which assists in enhancing the ease of installation.

In the present embodiment, the current-feeding unit 213 includes the current-feeding terminals 214. Unlike the fourth and fifth embodiments, the cable 213*a* or 242*a* is not exposed to the outside. This helps improve the outward appearance of the illumination device.

In the regard, the LED lamp 201 is greater in weight than the fluorescent lamp 203. Therefore, the LED lamp 201 cannot be securely held in place by merely holding the end caps 212 with the sockets 220. It is likely that the longitudinal center portion of the tubular body 210 may be flexed. In the present embodiment, however, the end caps 212 are held by the sockets 220 and, the current-feeding terminals 214 are mechanically held by the conductor plates 224*b*. This makes it possible to prevent the longitudinal center portion of the tubular body 210 from being flexed. Even if the end caps 212 are detached from the sockets 220, it is possible to prevent drop of the LED lamp 201 because the current-feeding terminals 214 are mechanically held by the conductor plates 224*b*.

While the sockets 220 used in the present embodiment are of a rotary type, plunger-type sockets may be used in place of the rotary sockets. The plunger-type sockets referred to herein mean that a plunger (not shown) movable in the axial direction of the lamp is arranged in at least one of the sockets 220. In order to mount the lamp to the sockets 220, the dummy pins 212*a* or the lamp pins arranged at one longitudinal end of the lamp is first inserted into the pin insertion holes (not shown) of one of the sockets 220. Then, the plunger is pressed by applying a load thereto in the axial direction of the end caps 212 or 230, during which time the dummy pins 212*a* or the lamp pins arranged at the other longitudinal end of the lamp are arranged to face the other socket 220. If the load removed from the plunger, the plunger returns back to the original position. The dummy pins 212*a* or the lamp pins arranged at the other longitudinal end of the lamp are inserted into the other socket 220. Consequently, the lamp is mounted to the sockets 220.

Figure 17A:
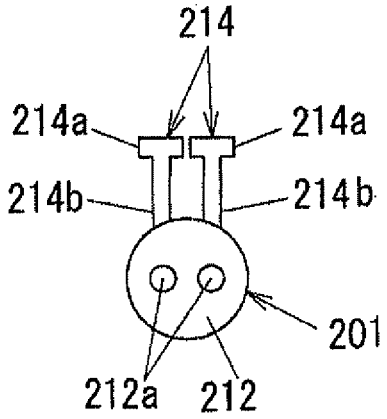
FIG. 17A is an end view showing an LED lamp in a modified example of the illumination device, and FIG. 17B a perspective view showing major components of the illumination device.
Figure 17B:
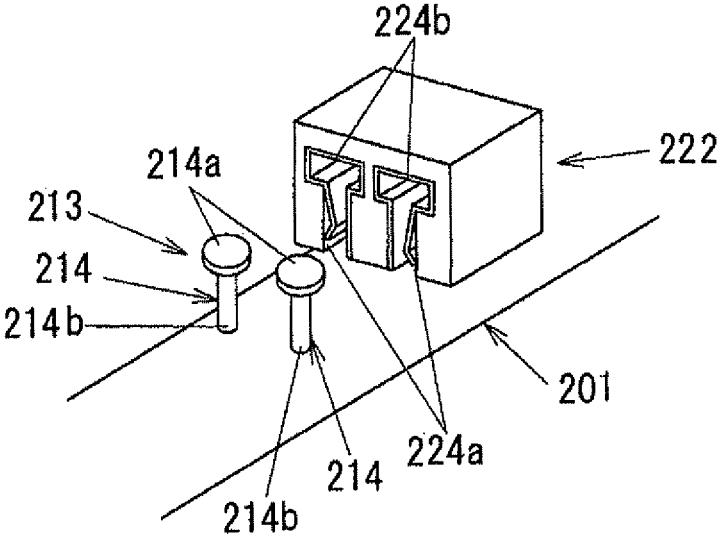

A method of mounting the LED lamp 201 when the sockets 220 are of a plunger type will now be described with reference to FIGS. 17A to 18C. In case where the sockets 220 are of a plunger type, the current-feeding unit 213 includes a pair of current-feeding terminals 214 arranged side by side along a direction perpendicular to the axial direction of the LED lamp 201 as shown in FIG. 17A. The connection unit 222 is arranged as illustrated in FIG. 17B so that the current-feeding terminals 214 can be guided into the insertion grooves 224*a* when the LED lamp 201 is moved in the axial direction thereof.

Figure 18A:
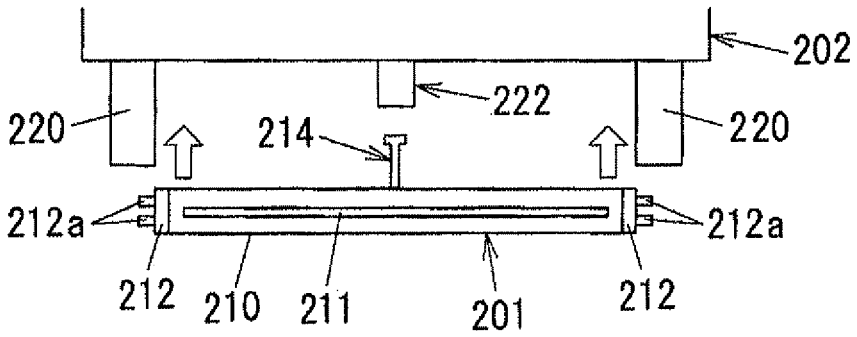
FIGS. 18A through 18C are views explaining how to mount the LED lamp to the socket of the illumination device.
Figure 18B:
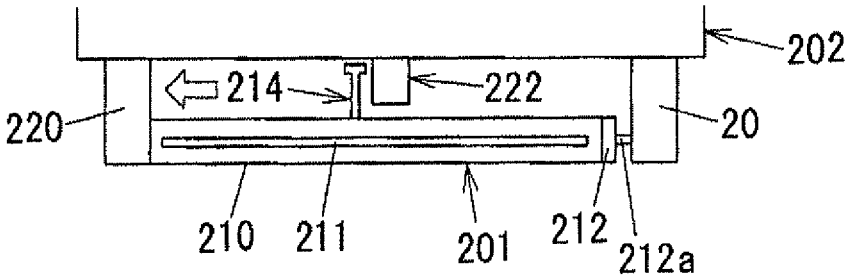
Figure 18C:
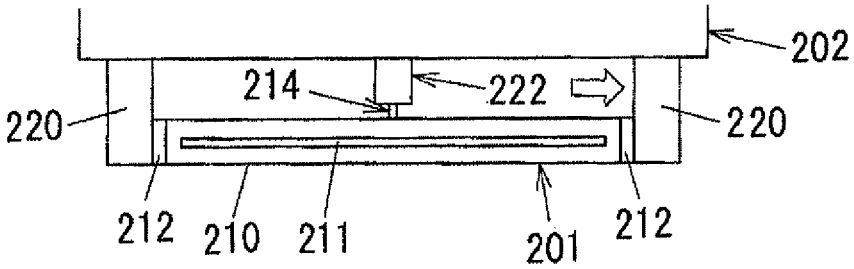

As shown in FIGS. 18A and 18B, the dummy pins 212*a* of the end cap 212 arranged at one longitudinal end (the left end in the drawings) of the LED lamp 201 are first inserted into one of the sockets 220 (the left socket 220 in the drawings), in which state the plunger is pressed by the LED lamp 201. At this time point, the current-feeding terminals 214 are positioned to face the insertion grooves 224*a* of the connection unit 222. Then, as shown in FIG. 18C, the dummy pins 212*a* of the end cap 212 arranged at the other longitudinal end (the right end in the drawings) of the LED lamp 201 are brought into an opposing relationship with the other socket 220 (the right socket 220 in the drawings), in which state the load is removed from the plunger. As a result, the plunger returns back to the original position whereby the dummy pins 212*a* or the lamp pins arranged at the other longitudinal end of the lamp are inserted into the other socket 220. Consequently, the end caps 212 of the LED lamp 201 are mounted to the sockets 220.

As the plunger returns back to the original position, the current-feeding terminals 214 are guided into the insertion grooves 224*a* of the connection unit 222. As a consequence, the head portions 214*a* of the current-feeding terminals 214 are caught by the inner surfaces of the conductor plates 224*b* whereby the current-feeding terminals 214 and are mechanically held by the conductor plates 224*b*. At the same time, the current-feeding terminals 214 and the conductor plates 224*b* are brought into contact with each other and electrically connected to one another. This establishes a current-feeding path extending from the second lighting unit 223 to the LED lamp 201 through the current-feeding terminals 214 and the conductor plates 224*b*. Consequently, a lighting current is fed from the second lighting unit 223 to the LED lamp 201, thereby turning on the LED lamp 201.

In case where the sockets 220 are of a plunger type as described above, the current-feeding unit 213 is attached to the connection unit 222 simultaneously with the end caps 212 being mounted to the sockets 220. Therefore, the task of mounting the LED lamp 201 to the sockets 220 and the task of attaching the current-feeding unit 213 to the connection unit 222 can be carried out though a single operation, which assists in enhancing the ease of installation.

While the LED lamp 201 including the light-emitting unit composed of light-emitting diodes is employed as the light source differing from the fluorescent lamp 203 in the respective embodiments described above, the present invention shall not be limited thereto. As an example, a light source including a light-emitting unit composed of organic electroluminescence elements may be employed in place of the LED lamp 201.

While certain embodiments of the present invention have been described above, it will be apparent to those skilled in the art that the present invention may be changed or modified in many different forms without departing from the spirit and scope of the invention defined in the claims. Accordingly, the foregoing description and the accompanying drawings should be construed to exemplify the present invention and not to limit the technical idea of the present invention.

What is claimed is:

1. A light source having an outer size set equal to the dimension of a straight tubular fluorescent lamp, comprising:

a straight light emitting tube; and end caps provided at the opposite end portions of the light emitting tube, wherein each of the end caps includes a pair of first pins arranged at the same positions as a pair of lamp pins of the fluorescent lamp, the first pins having the same shape as the lamp pins of the fluorescent lamp, and a current-feeding second pin protruding outwardly from each of the end caps, wherein a lighting current is fed to the light source through the second pin, and wherein the lighting current does not flow through the first pins.

2. The light source of claim 1, wherein the second pin is arranged in a coaxial relationship with a lamp axis, the pair of first pins and the second pin being arranged side by side along a straight line orthogonal to the lamp axis.

3. The light source of claim 2, wherein the second pin is greater in length than the first pins.

4. The light source of claim 2, wherein at least a portion of the second pin has a size greater than a groove width of a pin insertion groove provided in a rotor of a lamp socket to which only the fluorescent lamp is mounted in a rotatable manner but smaller than a groove width of a pin insertion groove provided in a rotor of a lamp socket to which the light source is mounted in a rotatable manner.

5. The light source of claim 1, wherein the second pin is arranged to protrude in a direction orthogonal to the lamp axis.

6. A lamp socket configured to support the light source or the fluorescent lamp of claim 2, comprising:

a socket body;

end cap receiving units to which the end caps of the light source or end caps of the fluorescent lamp recited are respectively mounted in a removable manner, each of the end cap receiving units including a pair of first current-feeding terminals to which the pair of first pins are connected, a second current-feeding terminal to which the second pin is connected and an insertion groove into which the first pins and the second pin are inserted, the first current-feeding terminals and the second current-feeding terminal being arranged within the socket body; and a rotor attached to the socket body for rotation about a lamp axis with respect to the socket body, the light source or the fluorescent lamp being mounted to the socket as the light source or the fluorescent lamp is rotated about the lamp axis together with the rotor in a state that the first pins and the second pin of the light source or the lamp pins of the fluorescent lamp are inserted into the insertion groove.

7. The lamp socket of claim 6, wherein the second current-feeding terminal is arranged at the opposite side of the first current-feeding terminals from the lamp.

8. A lamp socket configured to support the light source or the fluorescent lamp of claim 1, comprising:

end cap receiving units to which the end caps of the light source or end caps of the fluorescent lamp are respectively mounted in a removable manner, each of the end cap receiving units including first current-feeding terminals to which the first pins are connected, a second current-feeding terminal to which the second pin is connected and an insertion groove into which the first pins of the light source or the lamp pins of the fluorescent lamp are inserted; and a plunger biased toward the lamp, the light source or the fluorescent lamp being mounted to the socket as the light source or the fluorescent lamp is displaced toward the plunger in a state that each of the end caps of the light source or each of the end caps of the fluorescent lamp is brought into contact with the plunger.

9. The lamp socket of claim 8, further comprising:

a socket body for accommodation of the first current-feeding terminals and the second current-feeding terminal, the second pin being arranged to protrude in a direction orthogonal to a lamp axis, the socket body including an insertion groove into which the second pin is inserted, the second pin being inserted into the socket body through the insertion groove and connected to the second current-feeding terminal when the light source is mounted in place.

10. An illumination device, comprising:

the lamp socket recited in claim 6; and a lighting circuit for supplying a lighting current to the lamp socket.

11. A light source differing from a fluorescent lamp, comprising:

a light-emitting unit;

end caps mountable to sockets of an existing illumination device for the fluorescent lamp;

a current-feeding unit for feeding a lighting current to the light-emitting unit via a current-feeding path detouring the sockets, the current-feeding unit being positioned to face the illumination device when the end caps are mounted to the sockets; and a straight tubular body arranged to accommodate the light-emitting unit, the end caps being provided at the opposite ends of the tubular body, wherein a pair of dummy pins is protruded from the end caps wherein the pair of dummy pins and the end caps are electrically insulated from the light-emitting unit, and wherein the end caps are provided in pair, the current-feeding unit being arranged in a middle position between the end caps.

12. The light source of claim 11, wherein the light-emitting unit is positioned outward of the sockets when the end caps are mounted to the sockets.

13. An illumination device, comprising:

sockets to which end caps of a fluorescent lamp are respectively mounted;

a first lighting unit for feeding a lighting current to the fluorescent lamp through the sockets;

a device body arranged to hold the sockets and to accommodate the first lighting unit;

a second lighting unit accommodated within the device body to feed the lighting current to the light source recited in claim 11;

a current-feeding unit provided on one surface of the device body on which the sockets are arranged; and a connection unit arranged to establish a current-feeding path extending from the second lighting unit to the light source through the connection unit and the current-feeding unit.

14. The illumination device of claim 13, wherein the current-feeding unit and the connection unit include a holder unit arranged to mechanically hold the current-feeding unit and the connection unit.

15. The illumination device of claim 13, wherein the current-feeding unit is attached to the connection unit simultaneously with the end caps being mounted to the sockets.

* * * * *